US008465896B2

(12) United States Patent
Sekikawa et al.

(10) Patent No.: US 8,465,896 B2
(45) Date of Patent: Jun. 18, 2013

(54) BLACK TONER

(75) Inventors: Ayako Sekikawa, Susono (JP); Atsushi Tani, Suntou-gun (JP); Takaaki Kaya, Suntou-gun (JP); Shigeto Tamura, Suntou-gun (JP); Makoto Kambayashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 12/936,593

(22) PCT Filed: Feb. 19, 2010

(86) PCT No.: PCT/JP2010/053012

§ 371 (c)(1),
(2), (4) Date: Oct. 6, 2010

(87) PCT Pub. No.: WO2010/098413

PCT Pub. Date: Sep. 2, 2010

(65) Prior Publication Data

US 2011/0045398 A1 Feb. 24, 2011

(30) Foreign Application Priority Data

Feb. 27, 2009 (JP) ..... 2009-045639

(51) Int. Cl.
*G03G 9/087* (2006.01)

(52) U.S. Cl.
USPC ..... 430/109.4; 430/110.2; 430/111.4

(58) Field of Classification Search
USPC ..... 430/110.2, 109.4, 111.4
See application file for complete search history.

(56) References Cited

U.S. PATENT DOCUMENTS

| | | | |
|---|---|---|---|
| 5,399,455 | A | 3/1995 | Mikami et al. |
| 5,620,826 | A | 4/1997 | Tavernier et al. |
| 6,664,016 | B2 | 12/2003 | Kanbayashi et al. |
| 6,751,424 | B2 | 6/2004 | Komatsu et al. |
| 6,905,808 | B2 | 6/2005 | Itakura et al. |

(Continued)

FOREIGN PATENT DOCUMENTS

| | | | |
|---|---|---|---|
| JP | 5-297622 | A | 11/1993 |
| JP | 8-248680 | A | 9/1996 |

(Continued)

OTHER PUBLICATIONS

Ayaki, et al., U.S. Appl. No. 12/972,396, filed Dec. 17, 2010.

(Continued)

*Primary Examiner* — Christopher Rodee
(74) *Attorney, Agent, or Firm* — Fitzpatrick, Cella, Harper & Scinto

(57) ABSTRACT

A black toner has a toner particle including at least a resin (a) having a polyester as a main component, carbon black, and a wax, and a fine inorganic particle. When the Tgs of the black toner measured by DSC at temperature rise rate of 0.5° C./min and 4.0° C./min are defined as Tg(0.5) and Tg(4.0) respectively, Tg(0.5) is 35.0 to 60.0° C. and the difference between Tg(4.0) and Tg(0.5) is 2.0 to 10.0° C. When preparing a solution of which the black toner is dissolved in ethyl acetate and defined the concentration thereof as Cb1 (mg/mL) and the light absorbance thereof at 600 nm wavelength as A600, A600/Cb1 is less than 0.15. When preparing a solution of which the black toner is dissolved in chloroform and defined the concentration thereof as Cb2 (mg/mL) and the light absorbance thereof at 600 nm wavelength as A600, A600/Cb2 is 2.00 to 6.55.

13 Claims, 3 Drawing Sheets

U.S. PATENT DOCUMENTS

| | | | | |
|---|---|---|---|---|
| 7,147,980 | B2 | 12/2006 | Itakura et al. | |
| 7,229,727 | B2 | 6/2007 | Itakura et al. | |
| 7,244,539 | B2 | 7/2007 | Baba et al. | |
| 7,361,441 | B2 | 4/2008 | Itakura et al. | |
| 7,452,649 | B2 | 11/2008 | Magome et al. | |
| 7,718,338 | B2 | 5/2010 | Fujimoto et al. | |
| 7,776,501 | B2 | 8/2010 | Tamura et al. | |
| 7,794,908 | B2 | 9/2010 | Kaya et al. | |
| 7,794,909 | B2 | 9/2010 | Kaya et al. | |
| 7,935,771 | B2 | 5/2011 | Fukui et al. | |
| 7,943,281 | B2 | 5/2011 | Kaya et al. | |
| 2007/0015851 | A1 | 1/2007 | Akutagawa et al. | |
| 2007/0015852 | A1 | 1/2007 | Akutagawa et al. | |
| 2007/0111125 | A1 | 5/2007 | Tominaga et al. | |
| 2007/0275317 | A1 | 11/2007 | Fujimoto et al. | |
| 2008/0286668 | A1 | 11/2008 | Ishigami et al. | |
| 2008/0286675 | A1 | 11/2008 | Tani et al. | |
| 2009/0263738 | A1* | 10/2009 | Kaya et al. | 430/108.2 |
| 2009/0291380 | A1 | 11/2009 | Ayaki et al. | |
| 2009/0291383 | A1 | 11/2009 | Ayaki et al. | |
| 2010/0062355 | A1 | 3/2010 | Kaya et al. | |
| 2010/0119965 | A1 | 5/2010 | Tani et al. | |
| 2010/0273102 | A1 | 10/2010 | Tamura et al. | |
| 2010/0291482 | A1 | 11/2010 | Minami et al. | |
| 2011/0039200 | A1 | 2/2011 | Kaya et al. | |

FOREIGN PATENT DOCUMENTS

| | | | |
|---|---|---|---|
| JP | 3455523 | B2 | 10/2003 |
| JP | 2004-226572 | A | 8/2004 |
| JP | 2004-271919 | A | 9/2004 |
| JP | 2006-206848 | A | 8/2006 |
| JP | 2007-003840 | A | 1/2007 |
| JP | 2008-107679 | A | 5/2008 |
| JP | 2008-129308 | A | 6/2008 |
| JP | 2009-015212 | A | 1/2009 |
| WO | 2005/073287 | A1 | 8/2005 |

OTHER PUBLICATIONS

Sekikawa, et al., U.S. Appl. No. 12/995,977, International Filing Date Feb. 19, 2010.

European Search Report dated Nov. 19, 2012 in Application No. 10746292.1.

Chinese Office Action dated Sep. 18, 2012 in Chinese Application No. 201080009124.6.

* cited by examiner (Tfb: FLOW START TEMPERATURE TAKEN AS SOFTENING POINT (Tm))

BLACK TONER

TECHNICAL FIELD

The present invention relates to a toner for use in a recording method employing an electrophotographic method, an electrostatic recording method, a toner jet system recording method or the like.

BACKGROUND ART

In recent years, energy saving has been considered to be an important technical issue even in electrophotographic devices, and a drastic reduction in the amount of heat required by a fixing apparatus has been desired. Accordingly, the need for so-called "low-temperature fixability" in a toner, in which fixing with lower energy is possible, has been increasing.

Conventionally, a technique involving increasing the sharp melt properties of a binder resin is known as an effective method to enable the fixing at lower temperatures. In this point, polyester resins exhibit excellent characteristics.

On the other hand, from the viewpoint of improving image quality, reduction of the toner particle size and sharpening of the toner particle size distribution have progressed for the purpose of attaining higher resolution and higher definition. In addition, a spherical toner is now suitably used for the purpose of improving transfer efficiency and fluidity. As a method for efficiently preparing spherical toner particles with small particle sizes, a wet method is now used.

As a wet method capable of using a sharp-melting polyester resin, a "solution suspension" method has been proposed, in which spherical toner particles are produced by dissolving a resin component in an organic solvent which is immiscible with water, and dispersing the resultant solution in an aqueous phase to thereby form an oil droplet (Japanese Patent Application Laid-Open No. H08-248680). According to this method, a spherical toner with a small particle size can be easily obtained, which uses polyester having excellent low-temperature fixability as a binder resin.

Further, for the toner particles produced by the above-described solution suspension method using polyester as a binder resin, capsule type toner particles have also been proposed for the purpose of attaining even further low-temperature fixability.

Japanese Patent Application Laid-Open No. H05-297622 proposes a method in which a polyester resin, a low-molecular weight compound having an isocyanate group and the like are dissolved or dispersed in ethyl acetate to prepare an oil phase. This oil phase is dispersed in water to form droplets, and then interfacial polymerization of the compound having the isocyanate group is carried out at the droplet interface.

In this method, capsule toner particles having polyurethane or polyurea as an outermost shell can be obtained.

In addition, Japanese Patent Application Laid-Open No. 2004-226572 and Japanese Patent Application Laid-Open No. 2004-271919 propose a method in which toner base particles are prepared by a solution suspension method in the presence of resin fine particles formed from any one, or a combination thereof, of a vinyl resin, polyurethane resin, epoxy resin, and polyester resin to prepare toner particles having a toner base particle surface covered with the above-described resin fine particles.

Japanese Patent No. 3,455,523 proposes toner particles obtained by a solution suspension method using urethane-modified polyester resin fine particles as a dispersant.

International Publication No. WO2005/073287 proposes core-shell type toner particles formed by a shell layer (P) having one or more film-like layers formed from a polyurethane resin (a), and a core layer (Q) having one layer formed from a resin (b).

In these core-shell type toner particles, the viscosity of the core portion is lowered and the poor heat-resistant storage stability of the core portion is compensated with the heat-resistant storage stability of a shell portion. In this case, since a substance which is relatively strong against heat is used as the shell part, it is necessary to highly cross-link the resin used as the shell part or to use the resin having a high molecular weight. Consequently, there is a tendency for low-temperature fixability to be inhibited.

On the other hand, the coloring power of the toner is increased and the consumed amount of the toner is decreased by increasing the content of the colorant in the toner and controlling the dispersion state of the colorant. By decreasing the consumed amount of the toner, in line images and character images, a high-quality image can be provided with little scattering. Further, on the paper sheet, uneven portions are reduced and gloss is more uniform. Moreover, due to the decreased consumed amount of the toner, the toner container and the electrophotographic apparatus can be made more compact. In addition, running costs can be reduced, and power consumption can be decreased.

However, if the content of the colorant in the toner is simply increased, due to dispersion defects, for a color toner, the color gamut tends to be narrow and fixing impediments tend to occur as a result of the toner hardness increasing due to the filler effect. Further, due to a large amount of colorant being on the toner surface, the two-component developer carrier and sleeve parts tend to become contaminated. Moreover, when the moisture absorption properties of the colorant on the surface are large, a difference tends to occur in the charge amount depending on the environment.

Accordingly, in Japanese Patent Application Laid-Open No. 2006-206848, a toner particle is proposed which has a core-shell structure formed by a solution suspension method using a polyester resin in a binder resin and a polyester-containing urethane resin fine particle in the shell layer. Although exposure of the colorant can be thought to be suppressed by the shell layer, charge stability was insufficient. The reason for this can be thought to be due to a large amount of sulfonic acid groups and carboxyl groups introduced into the polyester-containing urethane resin fine particle, and the toner particle having a high amount of water absorption. When the toner particle has a high amount of water absorption, the charge amount of the toner particle tends to be insufficient. Further, the charge amount of a once-charged toner tends to decrease, and such a toner can have poor developing stability. In addition, the toner is plasticized by water absorption, and can agglomerate. This agglomeration tends to occur more easily when the glass transition temperature of a toner in a water-absorbed state decreases below a storage temperature.

Further, for a black toner, carbon black is usually used for the colorant. However, when the carbon black content is increased, a decrease in the charge amount, scattering and fogging during developing, and transfer defects tend to occur due to a decrease in resistance.

DISCLOSURE OF THE INVENTION

The present invention was achieved in view of the above-described problems. It is an object of the present invention to provide a black toner having high offset resistance and excellent charging performance as the toner having excellent low-temperature fixability. Another object of the present invention is to provide a black toner by which fine black characters, lines and dots, and a high-quality image can be obtained. Further, it is an object of the present invention to provide a black toner which can suppress the amount of water absorption of the black toner even under a high-temperature, high-humidity environment, and which can resolve problems such as a decrease in the charge amount, scattering and fogging during developing, and transfer defects which occur due to a decrease in resistance.

As a result of intensive investigations for resolving the above-described problems, the present inventors discovered that these problems could be resolved by the below toner, thereby arriving at the present invention.

Specifically, the present invention relates to a black toner including a toner particle, which includes at least a resin (a) having a polyester as a main component, carbon black, and a wax, and a fine inorganic particle, wherein, when the glass transition temperatures of the black toner measured by differential scanning calorimetry (DSC) at a rate of temperature rise of 0.5° C./min and 4.0° C./min are defined as Tg(0.5) (° C.) and Tg(4.0) (° C.) respectively, the Tg(0.5) is 35.0° C. or more to 60.0° C. or less, and the difference between the Tg(4.0) and the Tg(0.5) [Tg(4.0)−Tg(0.5)] is 2.0° C. or more to 10.0° C. or less; when preparing a solution of which the black toner is dissolved in ethyl acetate, and defined the concentration thereof as Cb1 (mg/ml), and the light absorbance thereof at a wavelength of 600 nm as A600, the ratio of A600 to Cb1 (A600/Cb1) is less than 0.15; and when preparing a solution of which the black toner is dissolved in chloroform, and defined the concentration thereof as Cb2 (mg/ml), and the light absorbance thereof at a wavelength of 600 nm as A600, the ratio of A600 to Cb2 (A600/Cb2) is 2.00 or more to 6.55 or less.

According to an preferred embodiment of the present invention, a black toner having high offset resistance and excellent charging performance, while also being a black toner having excellent low-temperature fixability, can be provided. Further, a black toner can be provided which is capable of obtaining a high-quality image in which the characters, lines, and dots are fine. Still further, a black toner can be provided which can suppress the amount of water absorption of the black toner even under a high-temperature, high-humidity environment, and which can resolve problems such as a decrease in the charge amount, scattering and fogging during developing, and transfer defects which occur due to a decrease in resistance.

Further features of the present invention will become apparent from the following description of exemplary embodiments with reference to the attached drawings.

BEST MODE FOR CARRYING OUT THE INVENTION

Figure 1:
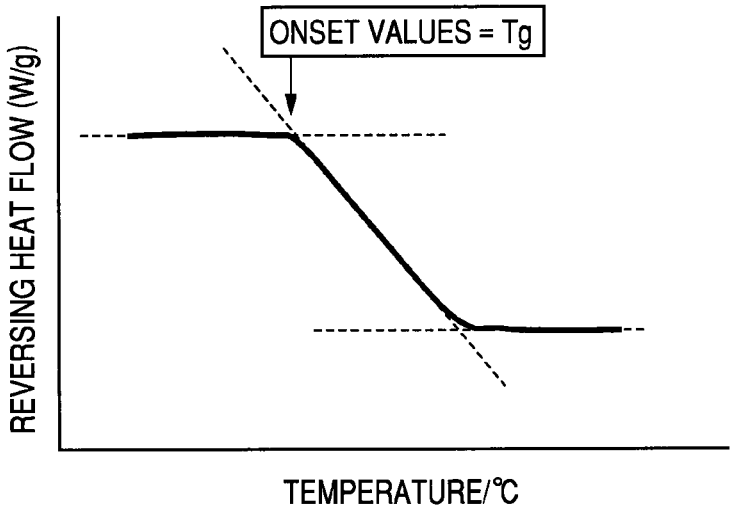
FIG. 1 illustrates a method for calculating Tg based on a DSC curve.

The toner according to the present invention (hereinafter sometimes referred to simply as "toner") is a black toner including a toner particle, which includes at least a resin (a) having a polyester as a main component, carbon black, and a wax, and a fine inorganic particle, wherein, when the glass transition temperatures of the black toner measured by differential scanning calorimetry (DSC) at a rate of temperature rise of 0.5° C./min and 4.0° C./min are defined as Tg(0.5) (° C.) and Tg(4.0) (° C.) respectively, the Tg(0.5) is 35.0° C. or more to 60.0° C. or less, and the difference between the Tg(4.0) and the Tg(0.5) [Tg(4.0)−Tg(0.5)] is 2.0° C. or more to 10.0° C. or less; when preparing a solution of which the black toner is dissolved in ethyl acetate, and defined the concentration thereof as Cb1 (mg/ml), and the light absorbance thereof at a wavelength of 600 nm as A600, the ratio of A600 to Cb1 (A600/Cb1) is less than 0.15; and when preparing a solution of which the black toner is dissolved in chloroform, and defined the concentration thereof as Cb2 (mg/ml), and the light absorbance thereof at a wavelength of 600 nm as A600, the ratio of A600 to Cb2 (A600/Cb2) is 2.00 or more to 6.55 or less.

The black toner according to the present invention uses a resin (a) having a polyester as a main component in the binder resin constituting the toner particle. The polyester can easily control melt properties relating to sharp melting properties, such as the softening point, the glass transition temperature, and the molecular weight distribution. However, polyesters generally tend to absorb water. Especially, if a polyester with a low softening point is used, the absorption tendency is substantial. Therefore, when such a polyester is used in the binder resin constituting the toner particle, the charging performance under a high-temperature, high-humidity environment tends to be insufficient.

Further, if the added amount of carbon black, which is the toner colorant, is increased to increase the coloring power of the black toner, the charging performance of the toner tends to decrease. Therefore, if the added amount of carbon black is increased, the dispersibility of the carbon black in the toner needs to be improved.

By including a specific amount of an aliphatic diol unit having a specific number of carbon atoms in the diol unit constituting the polyester included in the resin (a) having a polyester as a main component, a binder resin can be obtained which has a low amount of water absorption, and better dispersibility of the carbon black in the toner. Consequently, a black toner can be obtained which has excellent charging performance while also being a black toner having a higher coloring power. In addition, problems of polyester black toners including toner scattering and fogging can be resolved.

Further, like in the present invention, by using the resin (a) having a polyester as a main component as a constituent component of the toner particle, the melt properties relating to sharp melting properties, such as the softening point, the glass transition temperature, and the molecular weight distribution of the binder resin can be easily controlled. Consequently, a toner can be provided which can reduce the fixing temperature, can provide a high gloss at a low temperature, is easily and sufficiently melted during fixing, and has a high image density.

The black toner according to the present invention has, in measurement of the black toner by differential scanning calorimetry (DSC), when the glass transition temperature measured at a rate of temperature rise of 0.5° C./min is Tg(0.5) (° C.), and the glass transition temperature measured at a rate of temperature rise of 4.0° C./min is Tg(4.0) (° C.), a Tg(0.5) of 35.0° C. or more to 60.0° C. or less, and a difference between the Tg(4.0) and the Tg(0.5) [Tg(4.0)−Tg(0.5)] of 2.0° C. or more to 10.0° C. or less.

Tg(0.5) is preferably 37.0° C. or more to 58.0° C. or less. If Tg(0.5) is less than 35.0° C., although fixability at low temperatures is excellent, problems such as winding and offsetting at high temperatures tend to occur, so that the fixable temperature range tends to be narrow. Further, stability during storage of the toner tends to be harmed, and the stability during image storage after fixing tends to deteriorate. If Tg(0.5) is more than 60.0° C., it is difficult to realize excellent low-temperature fixability.

The above-described [Tg(4.0)−Tg(0.5)] is preferably 2.0° C. or more to 10.0° C. or less. If [Tg(4.0)−Tg(0.5)] is less than 2.0° C., there tends to be a reduction in heat-resistant storage stability and the effects of the wax and the carbon black are more easily manifested.

On the other hand, if [Tg(4.0)−Tg(0.5)] is more than 10.0° C., low-temperature fixability tends to deteriorate, and wax bleeding at the fixing nip tends to be insufficient, which tends to result in the occurrence of winding onto the fixing part.

In the measurement by differential scanning calorimetry (DSC), the reason for defining and focusing on the difference between the glass transition temperature Tg(0.5) (° C.) measured at a rate of temperature rise of 0.5° C./min and the glass transition temperature Tg(4.0) (° C.) measured at a rate of temperature rise of 4.0° C./min will be described below.

When the rate of temperature rise is 0.5° C./min, heat movement in a sample (toner) can easily attain equilibrium and thus the glass transition temperature is observed as a value for the whole sample. In contrast, when the rate of temperature rise is 4.0° C./min, the Tg of the measurement sample can be easily observed as a value close to the Tg of the surface material.

The values of the above-described Tg(0.5) and [Tg(4.0)−Tg(0.5)] can satisfy the above-described ranges by adjusting the amount of the surface layer (B).

When the concentration of the toner according to the present invention in a solution of the toner in ethyl acetate is Cb1 (mg/ml), and the light absorbance of the solution at a wavelength of 600 nm is A600, the ratio of A600 to Cb1 (A600/Cb1) is less than 0.15.

If (A600/Cb1) is 0.15 or more, the colorant (carbon black) is not uniformly dispersed in the toner, and is present near the surface. Further, the capsule structure tends to be insufficient. Thus, this tends to become a cause of deterioration in charging and part contamination.

The value of (A600/Cb1) is preferably 0.02 or more to 0.12 or less. The value of (A600/Cb1) can satisfy the above range by having the toner have a resin which is stable against ethyl acetate in which carbon black is not present in the toner surface.

When the concentration of the black toner according to the present invention in a solution of the toner in chloroform is Cb2 (mg/ml), and the light absorbance of the solution at a wavelength of 600 nm is A600, the ratio of A600 to Cb2 (A600/Cb2) is 2.00 or more to 6.55 or less.

Specifically, if (A600/Cb2) is 2.0 or more, the coloring power of the toner is high, and an image having a high image density can be provided. Further, because the coloring power of the toner is high, the toner load on the image can be reduced. A high coloring power is also advantageous in low-temperature fixing, and a high-quality image can be obtained.

The value of (A600/Cb2) is preferably 2.40 or more to 4.50 or less.

If (A600/Cb2) is more than 6.55, half tone density adjustment tends to become difficult, and the image quality tends to deteriorate. Further, the volume resistivity of the toner tends to decrease, and the charging performance tends to become unstable. Consequently, fogging tends to be more pronounced.

The value of (A600/Cb2) can satisfy the above range by adjusting the kind and added amount of carbon black to be added, and the dispersion state of the carbon black.

As described above, the toner particle used in the black toner according to the present invention contains the resin (a) having a polyester as a main component as a constituent component of the toner particle. Here, the term "main component" means that the polyester component accounts for 50 mass % or more of the total amount of the resin (a). Other than polyester, the resin (a) may contain, for example, a styrene-acrylic resin, a mixed resin of a polyester and styrene-acrylic resin, and an epoxy resin.

Further, the polyester included in the resin (a) having a polyester as a main component contains a diol unit as a constituent component. Preferably, this diol unit contains 50.0 mass % or more of an aliphatic diol unit having 4 to 12 (inclusive thereof) carbon atoms (preferably an aliphatic diol unit having 6 to 10 (inclusive thereof) carbon atoms).

If a polyester having an aliphatic diol unit having 3 or less carbon atoms is used as the constituent component of the above-described diol unit, the ester bond density per molecule increases, and the amount of water adsorption of the toner tends to increase. On the other hand, if a polyester having an aliphatic diol unit having 12 or more carbon atoms is used as a constituent component of the above-described diol unit, the charge amount of the toner tends to become unstable.

An example of a constituent component of the above-described diol unit other than an aliphatic diol unit is a bisphenol diol unit.

Further, in the present invention, if the polyester included in the resin (a) is a polyester containing 50.0 mass % or more of an aliphatic diol unit having 4 to 12 (inclusive thereof) carbon atoms in the diol unit constituting the polyester, the dispersibility of the carbon black in the black toner improves even more and thus a toner having a high coloring power can be obtained. In addition, the dielectric loss (tan δ) of the toner can be suppressed to a desired value.

Specifically, if a polyester is used which uses an aliphatic diol unit having 4 to 12 (inclusive thereof) carbon atoms as an alcohol component in the polyester included in the resin (a), the toner has a high coloring power, lower water absorbance, and better charge stability.

The amount of water absorption of the black toner according to the present invention under an environment having a temperature of 40° C. and a humidity of 95% RH is preferably 0.5 mass % or more to 1.5 mass % or less, and more preferably 0.8 mass % or more to 1.2 mass % or less. If the amount of water absorption of the toner is in this range, the charge amount of the toner becomes stable.

The amount of water absorption of the toner can satisfy the above range by adjusting the acid value of the resin (a).

The above-described resin (a) having a polyester as a main component will now be described in more detail.

In the present invention, when a large amount of carbon black is included in the toner particle, it was learned that if a polyester which uses an aliphatic diol unit having 4 to 12 (inclusive thereof) carbon atoms as an alcohol component is used as the binder resin, the dispersibility of the carbon black is excellent.

However, if a polyester having a low softening point is used as the binder resin in order to achieve low-temperature fixability, the amount of water absorption of the toner increases. Specifically, to produce a black toner having a high coloring power and a low softening point, it is preferred to satisfy both the suppression of low resistance caused by the carbon black, and the reduced suppression of the toner surface resistance caused by water absorption.

The amount of water absorption of the resin (a) having a polyester as a main component under an environment having a temperature of 40° C. and a humidity of 95% RH is preferably 0.5 mass % or more to 1.5 mass % or less. If the amount of water absorption of the resin (a) is in this range, it is easy to make the amount of water adsorption of the toner be within the range described above for the toner. In addition, the dispersibility of the carbon black can be prevented from decreasing.

The amount of water absorption of the resin (a) having a polyester as a main component can satisfy the above range by adjusting the below-described acid value of the resin (a).

The acid value of the resin (a) having a polyester as a main component is preferably 20.0 mg KOH/g or less, and more preferably 18.0 mg KOH/g or less.

In the acid value of the resin (a) is in this range, this contributes to making it more difficult for moisture to be absorbed, and to the stability of the toner charge amount. Further, the acid value of the resin (a) having a polyester as a main component can satisfy the above range by increasing the molecular weight of the resin (a) and by increasing the added amount of a terminal-modifying polyhydric acid, for example trimellitic acid.

Further, the hydroxyl group value of the resin (a) having a polyester as a main component is preferably 20.0 mg KOH/g or more to 80.0 mg KOH/g or less, and more preferably 20.0 mg KOH/g or more to 60.0 mg KOH/g or less.

If the hydroxyl group value of the resin (a) is in this range, the charge amount of the toner becomes stable.

In addition, the hydroxyl group value of the resin (a) can satisfy the above range by reducing the molecular weight of the resin (a) and by reducing the added amount of a terminal-modifying polyhydric acid, for example trimellitic acid.

In addition, the total of the acid value and the hydroxyl group value of the resin (a) having a polyester as a main component is preferably 20.0 mg KOH/g or more to 100.0 mg KOH/g or less, and more preferably 20.0 mg KOH/g or more to 70.0 mg KOH/g or less.

Thus, the polyester included in the resin (a) having a polyester as a main component contains a diol unit as a constituent component. Preferably, this diol unit contains 50.0 mass % or more of an aliphatic diol unit having 4 to 12 (inclusive thereof) carbon atoms. The content of the aliphatic diol unit having 4 to 12 (inclusive thereof) carbon atoms in the diol unit is more preferably 70 mass % or more, and even more preferably 80 mass % or more.

Examples of the aliphatic diol for forming the aliphatic diol unit having 4 to 12 (inclusive thereof) carbon atoms include 1,4-butanediol, 1,5-pentanediol, 1,6-hexanediol, 1,4-butenediol, 1,7-heptanediol, 1,8-octanediol, 1,9-nonanediol, 1,10-decanediol, 1,11-undecanediol, and 1,12-dodecanediol. Among these, an α,ω-linear alkanediol having 6 to 10 (inclusive thereof) carbon atoms is preferred, and 1,6-hexanediol, neopentyl glycol, 1,4-butenediol, 1,7-heptanediol, 1,8-octanediol, 1,9-nonanediol, and 1,10-decanediol are especially preferred.

Other than the above-described aliphatic diol unit having 4 to 12 (inclusive thereof) carbon atoms, the diol unit may optionally contain an aliphatic diol unit having 2 or 3 carbons atoms. Preferred examples of the aliphatic diol for forming such an aliphatic diol unit having 2 or 3 carbon atoms include ethylene glycol, 1,2-propylene glycol, and 1,3-propylene glycol.

To form the diol unit other than the above-described aliphatic diol unit, the diol unit may also contain a below-described alcohol. At this stage, the content of the below-described alcohol is, in the alcohol component, preferably less than 50 mole %, and more preferably 30 mole % or less. Examples of the alcohol include polyoxypropylene(2.2)-2,2-bis(4-hydroxyphenyl)propane and polyoxyethylene(2.2)-2,2-bis(4-hydroxyphenyl)propane.

On the other hand, examples of the carboxylic acid component to form the polyester include aromatic polycarboxylic acids, such as phthalic acid, isophthalic acid, terephthalic acid, trimellitic acid, and pyromellitic acid; aliphatic polycarboxylic acids such as fumaric acid, maleic acid, adipic acid, succinic acid, and succinic acid substituted with an alkyl group having 1 to 20 carbon atoms or an alkenyl group having 2 to 20 carbon atoms such as dodecenyl succinic acid and octenyl succinic acid; anhydrides of those acids; and alkyl (having 1 to 8 carbon atoms) esters of those acids.

From the viewpoint of the charging performance, the carboxylic acid may include an aromatic polycarboxylic acid compound. The content thereof is preferably 30 to 100 mol % and more preferably 50 to 100 mol % of the carboxylic acid component forming the polyester.

In addition, a raw material monomer may include, from the viewpoint of fixability, a trivalent or more polyhydric alcohol and/or trivalent or more polycarboxylic acid compound.

The method for producing the polyester is not specifically limited and may follow a known method. For example, in an inert gas atmosphere, the alcohol component and the carboxylic acid component can be subjected to condensation polymerization at a temperature of 180 to 250° C. optionally using an esterification catalyst to produce the polyester.

In the present invention, in the molecular weight distribution of the resin (a) having a polyester as a main component measured by gel permeation chromatography (GPC), the peak molecular weight is preferably 8,000 or less, more preferably 3,000 or more to less 5,500. Further, the ratio of resin (a) having a molecular weight of 100,000 or more is preferably 5.0% or less, and more preferably 1.0 or less.

If the molecular weight of the resin (a) satisfies the above stipulations, better fixability can be obtained.

In the present invention, the ratio of the resin (a) having a molecular weight of 1,000 or less is preferably 10.0% or less, and more preferably less than 7.0%. If the ratio is in this range, part contamination can be better suppressed.

In the present invention, to set the ratio of the resin (a) having a molecular weight of 1,000 or less to be 10.0% or less, the following preparation method can be suitably used.

To reduce the ratio of the resin (a) having a molecular weight to 1,000 or less, the resin is dissolved in a solvent, and the resultant solution is brought into contact with water and left to stand, which allows the ratio of the resin (a) having a molecular weight of 1,000 or less to be effectively reduced. More specifically, by this operation, the low-molecular-weight component having a molecular weight of 1,000 or less elutes into the water, and can be efficiently removed from the resin solution.

For the above-described reason, the solution suspension method can be used as the method for producing the toner particle. By using a method which leaves a solution in which the resin (a), carbon black, and the wax are dissolved or dispersed to stand while the solution is in contact with an aqueous medium before being suspended in the aqueous medium, the low-molecular-weight component can be removed efficiently.

In order to adjust the molecular weight of the toner, a resin (a) having two or more kinds of molecular weight may be mixed and used.

The carbon black will now be described in more detail.

The number average particle size of the carbon black primary particles is preferably 30 nm or more to 100 or less. If the number average particle size of the carbon black primary particles is in this range, carbon black dispersibility is good, and a good image can be obtained.

The carbon black content is, based on the toner particle, preferably 5.0 mass % or more to 15.0 mass % or less, and more preferably 6.0 mass % or more to 12.0 mass % or less.

The black toner according to the present invention preferably has a dielectric loss tangent (tan δ), represented by dielectric loss ε"/dielectric loss ε', at a frequency of 100,000 Hz of preferably 0.020 or less, more preferably 0.015 or less, and even more preferably 0.013 or less.

If the dielectric loss tangent (tan δ) is in the above range, the carbon black dispersibility in the toner improves, which causes the dielectric loss tangent (tan δ) to decrease. Consequently, decrease in the triboelectric charge amount is mitigated, and fogging and scattering tends to decrease. In addition, coloring power tends to improve.

Further, the black toner according to the present invention preferably has a volume resistivity of $1\times10^{12}$ Ω·cm or more, and more preferably $1\times10^{13}$ Ω·cm or more. On the other hand, the black toner preferably has a volume resistivity of $1\times10^{17}$ Ω·cm or less. If the volume resistivity is in this range, exposure of the carbon black on the toner surface can be prevented, which allows deterioration in the image quality due to scattering and fogging to be prevented. The volume resistivity can be adjusted by adjusting the dispersibility of the colorant (carbon black), and the exposure of the colorant on the toner particle surface.

In addition, the number average dispersion diameter of the carbon black in a cross-sectional photograph of the black toner according to the present invention taken by a transmission electron microscope (TEM) is preferably 100 nm or less to 500 nm or more, preferably 100 nm or less to 400 nm or more, and even more preferably 110 nm or less to 300 nm or more.

If the number average dispersion diameter of the carbon black is in the above range, the toner can exhibit a good coloring power and the occurrence of a red tint in the toner image can be prevented. The number average dispersion diameter of the carbon black can be adjusted based on the selection of the below-described dispersion method of the carbon black.

In the present invention, to increase the dispersibility of the carbon black to above normal, the following techniques may be appropriately used.

(1) Wet Dispersion (Media Dispersion)

This method involves dispersing carbon black (colorant) in a solvent in the presence of a dispersion medium. For example, the carbon black, other additives, and the organic solvent are mixed, and the resultant mixture is then dispersed using a disperser in the presence of the dispersion medium. The used dispersion medium is collected, and a carbon black dispersion is obtained. As the disperser, an Attritor (Mitsui Miike Machinery Co., Ltd.) is used, for example. Examples of the dispersion medium include beads of alumina, zirconia, glass, and iron. Zirconia beads, which hardly cause media contamination, are preferred. In this case, the beads having a diameter of 2 mm to 5 mm have excellent dispersibility, and are thus preferred.

(2) Wet Dispersion During Resin Addition

By adding the resin during the production of the above-described carbon black (colorant) dispersion, the dispersibility of the carbon black improves. Addition of the resin having a polyester as a main component which was synthesized using an aliphatic diol having the above-described specific number of carbon atoms is preferred from the perspective of improving the dispersibility of the carbon black. Further, by reducing the acid value and increasing the viscosity of the resin having a polyester as a main component, the dispersibility of the carbon black can be improved even more. In addition, since the resin having a polyester as a main component increases the affinity with the carbon black, and increase the viscosity of the carbon black dispersion, agglomeration of the carbon black during dispersion can be suppressed. Consequently, the dispersibility of the carbon black in the toner particle can be improved.

In the present invention, the carbon black may be used together with another black colorant other than carbon black. Further, the carbon black may be used together with another colorant as a tint adjustor. It is especially preferred to add a blue or cyan colorant to carbon black which exhibits a red tint.

As the cyan colorant, the following pigments or dyes may be used. Specifically, examples of such pigments include C.I. Pigment Blue 1, 7, 15, 15:1, 15:2, 15:3, 15:4, 16, 17, 60, 62, and 66, C.I. Vat Blue 6, and C.I. Acid Blue 45. Examples of such dyes include C.I. Solvent Blue 25, 36, 60, 70, 93, and 95. These may be added alone, or two or more kinds thereof may be added in combination.

Examples of the carbon black as the black colorant include furnace black, channel black, acetylene black, thermal black, lamp black and the like.

Further, magnetite and ferrite, which are magnetic, and a metal compound such as a non-magnetic composite oxide having a black color, may also be used together therewith.

The toner particle used in the black toner according to the present invention is preferably a capsule-type toner particle having a surface layer (B) on a surface of a toner base particle (A) having at least the resin (a) having a polyester as a main component, carbon black, and a wax.

In this capsule-type toner particle, it is preferred that the toner base particle (A) is completely covered by the surface layer (B).

When a capsule structure is not employed, due to separation of the wax on the toner surface, for example, the toner tends to agglomerate, stirring defects tend to occur in the developing zone, and clogging in a cleaner tends to occur. Further, the toner resistance, charge amount, and behavior during transfer tend to change due to exposure of the carbon black on the toner surface. In addition, when a toner base particle (A) having a low viscosity is used, it tends to be more difficult to satisfy heat-resistant storage stability.

However, for a capsule-type toner, although the heat-resistant storage stability improves, because the toner particle has a surface layer with a comparatively high viscosity, fixing impediments tend to occur, and it is difficult to obtain sufficient low-temperature fixability. Therefore, when employing a capsule-type toner particle, it is preferred for the surface layer (B) to have as low a viscosity as possible while satisfying heat-resistant storage stability.

The surface layer (B) preferably includes a resin (b).

Examples of the resin (b) include vinyl resins, urethane resins, epoxy resins, polyester resins, polyamide resins, polyimide resins, silicon resins, phenol resins, melamine resins, urea resins, aniline resins, ionomer resins, polycarbonate resins and the like. Two or more kinds of these resins may be used as the resin (b).

The resin (b) used in the present invention is preferably a resin which can form an aqueous dispersion. Therefore, from the perspective that an aqueous dispersion of fine spherical resin particles can be obtained easily, vinyl resins, urethane resins, epoxy resins, and polyester resins are preferred.

To reduce the viscosity of the surface layer (B), urethane resins and polyester resins having polyester as a constituent are preferred. From the standpoints of exhibiting suitable affinity with the solvent, water dispersibility, viscosity adjustment, and ease of achieving uniform particle size, the resin (b) preferably contains a resin which is a reaction product of a diol component and a diisocyanate component. Therefore, containing a urethane resin is more preferred. In the present invention, it is especially preferred for the surface layer (B) to contain a urethane resin (b) as a main component. Here, "as a main component" means that the urethane resin (b) contains preferably 50 mass % or more, and more preferably 70 mass %, of that component.

The urethane resin (b) will now be described in more detail using the following urethane resin as an example. The urethane resin (b) is a resin including a reaction product of a prepolymer diol component and a diisocyanate component. A urethane resin with various functions can be obtained by adjusting the diol component and the diisocyanate component.

The urethane resin (b) is a resin including a reaction product of a prepolymer diol component and a diisocyanate component. When the total number of moles of the diol component is [OH] (mol), and the total number of moles of the isocyanate component is [NCO] (mol), the ratio of the [NCO] to the [OH] ([NCO]/[OH]) is preferably 0.50 or more to 1.00 or less, and more preferably 0.55 or more to 0.90 or less.

If [NCO]/[OH] exceeds 1.00, the urethane resin (b) has an NCO terminal, which makes it difficult to obtain a urethane resin (b) with a uniform composition. Specifically, an active hydrogen compound needs to be used to seal the NCO residue and thus the sharp melt properties of the urethane resin (b) can deteriorate. Further, the raw material isocyanate component can multimerize with itself, which can make it more difficult to obtain the desired weight average molecular weight (Mw).

On the other hand, if [NCO]/[OH] is less than 0.50, it is difficult to adjust the Mw of the urethane resin (b).

Further, the urethane resin (b) is preferably a resin polymerized using at least 1.0 mass % or more to 30.0 mass % or less of a diol containing a carboxyl group and 10.0 mass % or more to 30.0 mass % or less of a diisocyanate.

If the diol containing a carboxyl group (hereinafter also referred to as "carboxyl-group-containing diol") component is more than 30 mass % based on the total amount of the urethane resin (b), the below-described Vb may exceed 50.0 mg KOH/g.

Further, if the carboxyl-group-containing diol component is less than 1.0 mass % based on the total amount of the urethane resin (b), the charge amount of the toner particle tends to decrease. In addition, if the toner is prepared by a solution suspension method, the core tends to become exposed, and the particle size distribution of the toner particle tends to widen. Consequently, developability and durability stability tend to deteriorate.

If the diisocyanate component is less than 10.0 mass % based on the total amount of the urethane resin (b), the solvent resistance of the toner tends to deteriorate, and the particle size uniformity in capsule production tends to decrease. Further, if the diisocyanate component is more than 30.0 mass % based on the total amount of the urethane resin (b), the viscosity of the urethane resin (b) increases, which can inhibit fixability at a low-temperature. In addition, the amount of water absorption of the urethane resin (b) tends to increase, and the storage stability under a harsh environment tends to deteriorate.

When the acid value of the urethane resin (b), which is obtained by measuring a dissolved product of the urethane resin (b) dissolved in tetrahydrofuran by a titration method, is Vb (mg KOH/g), Vb is preferably 10.0 mg KOH/g or more to 50.0 mg KOH/g or less, and more preferably 12.0 mg KOH/g or more to 48.0 mg KOH/g or less.

If Vb is in the above range, it is more difficult for the surface layer (B) to peel away from the toner particle, and the durability stability is high. Vb is preferably adjusted by the blend ratio of a carboxyl-group-containing monomer.

In the present invention, the amount of water absorption of the urethane resin (b) under an environment of a temperature of 40° C. and a humidity of 95% RH is preferably 3.5 mass % or less, and more preferably 0.5 mass % or more to 2.5 mass % or less.

If the amount of water absorption of the urethane resin (b) under an environment of a temperature of 40° C. and a humidity of 95% RH is in the above range, the amount of water absorption of the toner can be appropriately controlled. Further, this also contributes to the storage stability of the toner.

The amount of water absorption of the urethane resin (b) can be adjusted to within the above range by adjusting the acid value of the urethane resin (b).

Examples of the diisocyanate component used in the urethane resin (b) include aromatic diisocyanates having 6 to 20 carbon atoms (excluding the carbon atoms in the NCO groups, hereinafter the same), aliphatic diisocyanates having 2 to 18 carbon atoms, alicyclic diisocyanates having 4 to 15 carbon atoms, aromatic hydrocarbon diisocyanates having 8 to 15 carbon atoms, and modified diisocyanate thereof (modified substances having a urethane group, carbodiimide group, allophanate group, urea group, biuret group, urethodione group, urethoimine group, isocyanurate group, or oxazolidone group, hereinafter also referred to as "modified diisocyanate"), and a mixture of two or more kinds thereof.

Examples of the aromatic diisocyanate include 1,3-phenylene diisocyanate, 1,4-phenylene diisocyanate, and 1,5-naphthylene diisocyanate.

Examples of the aliphatic diisocyanate include ethylene diisocyanate, tetramethylene diisocyanate, hexamethylene diisocyanate (HDI), and dodecamethylene diisocyanate.

Examples of the alicyclic diisocyanate include isophorone diisocyanate (IPDI), dicyclohexylmethane-4,4'-diisocyanate (MDI), cyclohexylene diisocyanate, and methylcyclohexylene diisocyanate (TDI).

Of those, preferred are an aliphatic diisocyanate having 4 to 12 carbon atoms, and an alicyclic diisocyanate having 4 to 15 carbon atoms. Especially preferred are HDI and IPDI.

In addition, in the present invention, an isocyanate compound having three or more functional groups may be used in addition to the above-mentioned diisocyanate components. Examples of isocyanate compounds having three or more functional groups include polyallyl polyisocyanate (PAPI), 4,4',4"-triphenylmethane triisocyanate, m-isocyanato phenylsulfonyl isocyanate, and p-isocyanato phenyl sulfonyl isocyanate.

Examples of the diol component used in the urethane resin (b) include alkylene glycols (ethyleneglycol, 1,2-propylene glycol, 1,3-propylene glycol, 1,4-butane diol, 1,6-hexane diol, octane diol, and decane diol); alkylene ether glycols (diethylene glycol, triethyleneglycol, dipropyleneglycol, polyethyleneglycol, and polypropylene glycol); alicyclic diols (1,4-cyclohexane dimethanol, hydrogenated bisphenol A and the like); bisphenols (bisphenol A, bisphenol F, bisphenol S and the like); alkylene oxide (ethylene oxide, propylene oxide, butylene oxide, and the like) adducts of the above-described alicyclic diols; alkylene oxide (ethylene oxide, propylene oxide, butylene oxide, and the like) adducts of the above-described bisphenols; polylactone diols (poly-ε-caprolactonediol and the like) and polybutadiene diol.

The alkyl moiety of the alkylene ether glycol may be linear or branched. In the present invention, alkylene glycol having a branched structure is preferably used.

Of those, preferred is an alkyl structure in view of solubility (affinity) with ethyl acetate, and an alkylene glycol having 2 to 12 carbon atoms is preferably used.

In the present invention, in addition to the diol components, a polyester oligomer having a hydroxyl group at a terminal (polyester oligomer having a terminal diol) may also be used as a suitable diol component.

From the perspective of reactivity, and solubility in ethyl acetate, the molecular weight (number average molecular weight) of the polyester oligomer having a terminal diol is preferably 3,000 or less, and more preferably 800 or more to 2,000 or less.

In addition, the content of the polyester oligomer having a terminal diol, based on the monomers forming the reaction product of the diol component and the diisocyanate component, is preferably 1 mol % or more to 10 mol % or less, and more preferably 3 mol % or more to 6 mol % or less. If the polyester oligomer having a terminal diol is in the above-described range, while obtaining suitable hardness as the shell and maintaining good fixability, a high affinity with the resin (a) can be obtained, and a higher density between the core and the shell can be obtained.

Preferably, a polyester skeleton of the polyester oligomer having a terminal diol and a polyester skeleton of the resin (a) is the same for forming good capsule-type toner particles. The reason for this relates to the affinity between the reaction product of the diol component and the diisocyanate component on the surface layer and the toner base particles.

Further, the polyester oligomer having a terminal diol may have an ether bond modified with ethylene oxide, propylene oxide or the like.

The urethane resin (b) may also include, in addition to the resin which is the reaction product of the diol component and the diisocyanate component, a compound in which an amino compound and an isocyanate compound are linked by a urea bond.

Examples of the amino compound include diaminoethane, diaminopropane, diaminobutane, diaminohexane, piperazine, 2,5-dimethylpiperazine, and amino-3-aminomethyl-3,5,5-trimethyl cyclohexane (isophoronediamine, IPDA).

The urethane resin (b) may also include, in addition to the above compounds, a reaction product of an isocyanate compound and a compound having a group on which a highly-reactive hydrogen is present, such as a carboxylic acid group, a cyano group, and a thiol group.

The resin which is the reaction product of the diol component and the diisocyanate component may include a carboxylic acid group, a sulfonic acid group, a carboxylate, or a sulfonate in a side chain. Including such a group is effective, because an aqueous dispersion is easily formed during solution suspension, and the resin forms a capsule-type structure stably without dissolving in the oil phase solvent. The urethane resin can be easily produced by introducing the carboxylic acid group, sulfonic acid group, carboxylate, or sulfonate into a side chain of the diol component or the diisocyanate component.

Examples of the diol component introduced with a carboxylic acid group or a carboxylate in a side chain include dihydroxyl carboxylates such as dimethylol acetate, dimethylol propionate, dimethylol butanoate, dimethylol butyrate, and dimethylol pentanoate, and metal salts thereof.

On the other hand, examples of the diol component introduced with a sulfonic acid group or a sulfonate in a side chain include sulfoisophthalate, N,N-bis(2-hydroxyethyl)-2-aminoethane sulfonate, and metal salts thereof.

The content of the diol component introduced with the carboxylic acid group, sulfonic acid group, carboxylate, or sulfonate in a side chain is preferably 10 mol % or more to 50 mol % or less, and more preferably 20 mol % or more to 30 mol % or less, based on all of the monomers forming the reaction product of the diol component and the diisocyanate component.

If the content of the diol component is less than 10 mol %, the dispersibility of resin fine particles tends to deteriorate, and granulation properties may be harmed. On the other hand, if the content of the diol component is more than 50 mol %, the reaction product of the diol component and the diisocyanate component may dissolve into an aqueous medium, and thus may not exert the function as a dispersant.

The surface layer (B) may be formed by resin fine particles including the resin (b) (in particular, the particles having urethane resin (b) as a main component). The method for preparing the resin fine particles is not especially limited. Examples thereof may include an emulsion polymerization method, or a method involving dissolving the resin in a solvent, or melting the resin, to liquefy the resin, and suspending the liquid in an aqueous medium to form particles.

In the preparation of the resin fine particles, a known surfactant or dispersant can be used, or the resin forming the resin fine particles can be provided with self-emulsifying properties.

Examples of the solvent that can be used when the resin fine particles are prepared by dissolving the resin in a solvent include, but not especially limited to, hydrocarbon solvents such as ethyl acetate, xylene, and hexane, halogenated hydrocarbon solvents such as methylene chloride, chloroform, and dichlorethane, ester solvents such as methyl acetate, ethyl acetate, butyl acetate, and isopropyl acetate, ether solvents such as diethyl ether, ketone solvents such as acetone, methyl ethyl ketone, diisobutyl ketone, cyclohexanone, and methylcyclohexane, and alcohol solvents such as methanol, ethanol, and butanol.

A preferred embodiment of a method of preparing the resin fine particles is to use resin fine particles containing the reaction product of the diol component and the diisocyanate component as a dispersant. In this production method, a prepolymer having the diisocyanate component is produced, the prepolymer is rapidly dispersed in water, and subsequently, the diol component is added to the mixture to extend or crosslink the chain.

More specifically, in this production method, a prepolymer having a diisocyanate component, and, as required, any other necessary component are dissolved or dispersed in a solvent having high solubility in water such as acetone or an alcohol. The resultant mixture is then charged into water to rapidly disperse the prepolymer having a diisocyanate component, and then the diol component is added to produce a reaction product of the diol component and the diisocyanate component having the desired physical properties.

In the present invention, if the toner particle is formed as a capsule, the number average particle size of the resin fine particles containing the urethane resin (b) is preferably 30 nm or more to 100 nm or less. If the number average particle size of the resin fine particles is in this range, granulation stability in the aqueous phase is good.

Examples of the wax used in the present invention include aliphatic hydrocarbon waxes such as a low-molecular-weight polyethylene, low-molecular-weight polypropylene, low-molecular-weight olefin copolymer, a microcrystalline wax, paraffin wax, and a Fischer-Tropsch wax; oxides of aliphatic hydrocarbon waxes such as polyethylene oxide wax; waxes mainly formed from fatty acid esters, such as aliphatic hydrocarbon ester waxes; partially or wholly deacidified fatty acid esters such as a deacidified carnauba wax; partially esterified compounds of fatty acids and polyhydric alcohols such as behenic monoglyceride; and methyl ester compounds having a hydroxyl group obtained by the hydrogenation of a vegetable oil.

In the present invention, in the solution suspension method, from the perspective of ease of producing a wax dispersion, ease of incorporating the wax into the toner during granulation, bleeding properties from the toner during fixing, and release properties after fixing, it is particularly preferred to use an ester wax. Either a natural ester wax or a synthetic ester wax may be used as the ester wax. Further, these waxes may be partially saponified.

Examples of the synthetic ester wax include monoester waxes synthesized from a long, linear, saturated fatty acid and a long, linear, saturated alcohol. It is preferred to use a long, linear, saturated fatty acid having about 6 to 29 carbon atoms, and a long, linear, saturated alcohol having about 5 to 28 carbon atoms. Examples of the natural ester waxes include candelilla wax, carnaba wax, rice wax, haze wax, jojoba oil, bees wax, lanoline, castor wax, montan wax, and derivatives thereof.

The reason for this is not clear, but is presumed that the wax has a linear structure, so mobility in a melted state may increase. Namely, it is necessary during fixing for the wax to pass between substances which have comparatively high polarity, such as the polyester acting as the binder resin and the reaction product of a diol and a diisocyanate on the surface layer, and spread on the toner surface layer. Therefore, to pass between those high polarity substances, the fact that the wax has as a linear structure is thought to act advantageously.

Further, in the present invention, in addition to having a linear structure, the ester is preferably a monoester. For the same reason as described above, this is because if the wax has a bulky structure in which each ester is bound to a branched chain, it can be difficult for the wax to spread on the surface of the toner particles by passing through the polyester or the high polarity substances.

In addition, the use of the ester wax in combination with a hydrocarbon wax is a preferred embodiment of the present invention.

In the present invention, the content of the wax in the toner is preferably 5.0 mass % or more to 20.0 mass % or less, and more preferably 5.0 mass % or more to 15.0 mass % or less. If the wax content is less than 5.0 mass %, the toner release properties is difficult to maintain. If the wax content is more than 20.0 mass %, the wax tends to be exposed on the toner surface, which can cause the heat-resistant storage stability to deteriorate. In the present invention, the wax may have a peak temperature of a maximum endothermic peak at 60 to 90° C. in differential scanning calorimetry (DSC) measurement. When the peak temperature is in this range, the wax is suitably melted during fixing, and good low-temperature fixability and offset resistance can be obtained. In addition, exposure of the wax on the toner surface during storage can be suppressed, and deterioration of the heat-resistant storage stability can be suppressed.

The black toner of the present invention may include crystalline polyester. The crystalline polyester is preferably a resin obtained by subjecting an alcohol component including 60 mol % or more of an aliphatic diol having 2 to 6 carbon atoms (preferably 4 to 6 carbon atoms), and a carboxylic acid component including 60 mol % or more of an aliphatic dicarboxylic acid compound having 2 to 8 carbon atoms (preferably 4 to 6 carbon atoms, and more preferably 4 carbon atoms) to condensation polymerization.

Examples of the aliphatic diol having 2 to 6 carbon atoms used to obtain the crystalline polyester include ethylene glycol, 1,4-butanediol, 1,5-pentanediol, 1,6-hexanediol, and 1,4-butene diol.

Examples of the aliphatic dicarboxylic acid compound having 2 to 8 carbon atoms include oxalic acid, malonic acid, maleic acid, fumaric acid, citraconic acid, itaconic acid, glutaconic acid, succinic acid, adipic acid, and anhydrides and alkyl (having 1 to 3 carbon atoms) esters of these acids. Of those, fumaric acid and adipic acid are preferable, and fumaric acid is particularly preferable.

The crystalline polyester can be obtained, for example, by subjecting the alcohol component and the carboxylic acid component to condensation polymerization by reacting at a temperature of 150 to 250° C. in an inert gas atmosphere and optionally using an esterification catalyst.

The black toner according to the present invention may also include a known charge control agent. Examples of charge control agents which can be used in the present invention include known charge control agents, such as the following.

Negative charge control agents include metallic compounds of aromatic carboxylic acids like salicylic acid, alkyl salicylic acid, dialkyl salicylic acid, naphthoic acid, and dicarboxylic acids, metal salts or metal complexes of an azo dye or an azo pigment, polymer compounds having a sulfonic acid or a carboxylic acid group in a side chain, boron compounds, urea compounds, silicon compounds, calixarenes and the like. Positive charge control agents include quaternary ammonium salts, polymer compounds having such a quaternary ammonium salt in a side chain, guanidine compounds, nigrosine compounds and imidazole compounds.

A simple method for producing the toner particles used in the present invention will now be described. A simple method for producing a capsule-type toner particle will now be described. However, the method for producing the toner particle used in the present invention is not limited to this method.

The toner particle used in the present invention is preferably obtained by a production method including a step of obtaining a dissolved product or a dispersion product (oil phase) obtained by dissolving or dispersing a mixture containing at least the resin (a) having a polyester as a main component, the carbon black, and the wax in an organic medium; and a step of dispersing the dissolved product or dispersion product in an aqueous medium (aqueous phase) in which the resin fine particles containing the resin (b) (especially preferably, having a urethane resin (b) as a main component) are dispersed, removing the solvent from the obtained dispersion, and drying the resultant product.

Further, the step of obtaining a dissolved product or a dispersion product (oil phase) obtained by dissolving or dispersing a mixture containing at least the resin (a) having a polyester as a main component, the carbon black, and the wax in an organic medium preferably includes a step of producing in advance a mixture containing at least the carbon black and a part of the resin (a) having a polyester as a main component, and a step of obtaining a dissolved product or a dispersion product (oil phase) obtained by dissolving or dispersing a mixture containing at least the mixture, the rest of the resin (a) having a polyester as a main component and the wax in an organic medium.

In the above-described system, the resin fine particles function as a dispersant when the dissolved product or the dispersion product (oil phase) is suspended in the aqueous phase. By preparing the toner particles by this method, capsule-type toner particles can be easily prepared without requiring an aggregation process on the toner surface.

Thus, in the present invention, it is preferred to use the resin fine particles containing the resin (b) dispersed in the aqueous medium. The resin fine particles containing the resin (b) may be blended in a desired amount according to stability of the oil phase and the capsulation of the toner base particle. In the present invention, when the resin fine particles are used for forming the surface layer (B), the resin fine particles are preferably 2.5 mass % or more to 15.0 mass % or less based on the toner particle. If the resin fine particles are less than 2.5 mass %, capsulation tends to be insufficient. On the other hand, if the resin fine particles are more than 15.0 mass %, the nature of the surface layer (B) is strongly reflected, even during fixing, and it is more difficult for the core characteristics to be exhibited. More preferred is 3.0 mass % or more to 12.0 mass % or less, and even more preferred is 3.5 mass % or more to 10.0 mass % or less.

In the preparation method for the oil phase, examples of the organic medium for dissolving the resin (a) include hydrocarbon solvents such as ethyl acetate, xylene and hexane, halogenated hydrocarbon solvents such as methylene chloride, chloroform, and dichlorethane, ester solvents such as methyl acetate, ethyl acetate, butyl acetate, and isopropyl acetate, ether solvents such as diethyl ether, and ketone solvents such as acetone, methyl ethyl ketone, diisobutyl ketone, cyclohexanone, and methyl cyclohexane.

The resin (a) may be used in the form of a resin dispersion in which the resin is dissolved in the organic medium. In this case, the resin can be blended in the organic medium as a resin component in the range of 40 mass % to 60 mass %. This value depends on the viscosity and solubility of the resin, and is selected in view of facilitating production in the next step. In addition, it is preferred to heat the resin at a boiling point of the organic medium or lower when dissolving the resin, as this increases the solubility of the resin.

The wax or the carbon black can also be in the form of a dispersion in the organic medium. More specifically, it is preferred to produce the respective wax or the carbon black (colorant) dispersion by mechanically pulverizing the wax or the carbon black beforehand by a wet method or a dry method, and then dispersing the pulverized wax or the carbon black in the organic medium.

The dispersibility of the wax and the carbon black can be increased by adding a dispersant or a resin which suits each of the wax and the carbon black. Such dispersants and resins vary depending on the wax, the carbon black (colorant), the binder resin, and the organic solvent to be used, and thus may be used by selecting them appropriately.

The oil phase can be prepared by blending the resin dispersion, the wax dispersion, the carbon black (colorant) dispersion, and the organic medium in desired amounts, and dispersing each component in the organic medium.

The aqueous medium may include water alone, or may also include water and a solvent which is miscible with water. Examples of solvents miscible with water include alcohols (methanol, isopropanol, ethylene glycol), dimethyl formamide, tetrahydrofuran, cellosolves (methyl cellosolve), and lower ketones (acetone, methyl ethyl ketone). In addition, a preferred method is to mix the organic medium used as the oil phase in an appropriate amount in the aqueous medium. This method has the effect of increasing droplet stability during granulation and facilitating suspension of the oil phase in the aqueous medium.

A known surfactant, dispersion stabilizer, water-soluble polymer, or viscosity modifier can also be added to the aqueous medium.

Examples of the surfactant include an anionic surfactant, a cationic surfactant, an amphoteric surfactant, and a nonionic surfactant. These surfactants can be arbitrarily selected based on the polarity during formation of the toner particles.

Specific examples include anionic surfactants such as alkylbenzene sulfonate, α-olefin sulfonate, and ester phosphate; cationic surfactants including amine salt type surfactants such as alkyl amine salts, amino alcohol fatty acid derivatives, polyamine fatty acid derivatives, and imidazoline, and quaternary ammonium salt type surfactants such as alkyltrimethyl ammonium salts, dialkyldimethyl ammonium salts, alkyldimethylbenzyl ammonium salts, pyridinium salts, alkylisoquinolinium salts, and benzethonium chloride; nonionic surfactants such as fatty acid amide derivatives and polyalcohol derivatives; and amphoteric surfactants such as alanine, dodecyldi(aminoethyl)glycine, di(octylaminoethyl) glycine, and N-alkyl-N,N-dimethyl ammonium betaine.

In the present invention, a dispersion stabilizer is preferably used. The reason is as follows. An organic medium in which the resin (a) acting as the main component of the toner is dissolved has a high viscosity. The dispersion stabilizer surrounds oil droplets formed when finely dispersing the organic medium by a high shear force, thereby preventing the droplets from reagglomerating, and stabilizing the dispersion.

An inorganic dispersion stabilizer and an organic dispersion stabilizer can be used as the dispersion stabilizer. For an inorganic dispersion stabilizer, it is preferred that the stabilizer can be removed by an acid which has no affinity with the solvent, such as hydrochloric acid, because the toner particles are formed in a state where the stabilizer adheres onto the surface of particles after dispersion. For example, calcium carbonate, calcium chloride, sodium hydrogen carbonate, potassium hydrogen carbonate, sodium hydroxide, potassium hydroxide, hydroxyapatite, or calcium triphosphate can be used.

The dispersion apparatus used when preparing the toner particles is not especially limited. A general-purpose apparatus can be used, such as a low-speed shearing type, high-speed shearing type, friction type, high-pressure jet type, or ultrasonic. A high-speed shearing type apparatus is preferable, so that the dispersed particles may have a particle size of about 2 to 20 μm.

Examples include continuous emulsifiers such as Cavitron (manufactured by EuroTec, LTD) and Fine Flow Mill (manufactured by Pacific Machinery & Engineering Co., Ltd.), and batch type or continuous duplex emulsification machines such as TK-homomixer (manufactured by Primix Corporation), Clear Mix (manufactured by M Technique Co., Ltd.) and Filmix (manufactured by Primix Corporation).

When a high-speed shearing type disperser is used as the dispersion apparatus, the number of revolutions of the stirring blade, which is not especially limited, is typically about 1,000 to 30,000 rpm, and preferably 3,000 to 20,000 rpm.

In the case of a batch type disperser, the time period for dispersion using the dispersion apparatus is typically 0.1 to 5 minutes. The temperature at the time of dispersion is typically 10 to 150° C. (under pressure), or preferably 10 to 100° C.

To remove the organic solvent from the obtained dispersion, the temperature of the entire system may be gradually increased so that the organic solvent in the droplets is completely evaporated and removed.

Alternatively, the dispersion may be sprayed into a dry atmosphere, so that the non-water-soluble organic solvent in the droplets is completely removed to form the toner particles, and at the same time the water in the dispersion is evaporated and removed.

In this case, as the dry atmosphere in which the dispersion liquid is sprayed, generally used is a gas obtained by heating air, nitrogen, carbon dioxide gas, or a combustion gas, and in particular, various air streams heated to temperatures equal to or higher than the boiling point of the solvent having the highest boiling point among the solvents to be used.

The desired quality can be properly obtained even with a short-duration treatment using one of a spray dryer, a belt dryer, or a rotary kiln.

When the dispersion obtained by the above-described method exhibits a wide particle size distribution, and is subjected to washing and drying treatments while that particle size distribution is maintained, the particle size distribution can be made orderly by classifying the toner particles to have a desired particle size distribution.

It is preferred to remove as much as possible of the dispersion stabilizer used in the above-described method from the resultant dispersion. The removal is more preferably performed simultaneously with the classification operation.

In the production method of the toner particle, after the organic solvent has been removed, a heating process may be further provided. By providing the heating process, the toner particle surfaces can be made smoother and the spherical degree can be adjusted.

In the classification operation, a portion of the fine particles can be removed in the liquid by a cyclone, a decanter, centrifugation or the like. Of course, the classification may be performed after obtaining a powder after drying, but classification in the liquid is preferred from the standpoint of efficiency.

Unnecessary fine particles or coarse particles obtained in the classification operation may be returned to the production process again and then used for forming particles. In this case, the fine particles or coarse particles may be in a wet state.

In the present invention, a weight average particle size (D4) of the black toner is preferably 4.0 to 9.0 μm, and more preferably 4.5 to 7.0 μm. If the weight average particle size of the toner is in this range, the occurrence of charge-up of the toner can be well suppressed even after using for a long time. Further, problems such as the density deteriorating can be suppressed. In addition, good thin line reproducibility can be obtained in a line image or the like.

The black toner according to the present invention includes inorganic fine particles as an external additive for aiding the fluidity, developability, and charge performance of the toner.

The number average particle size of the primary particles of the inorganic fine particles is preferably 5 nm to 2 μm, and more preferably 5 nm to 500 nm. In addition, the inorganic fine particles have a specific surface area according to a BET method of preferably 20 to 500 $m^2/g$.

The inorganic fine particles are used in a ratio of preferably 0.01 to 5 parts by mass, or more preferably 0.01 to 2.0 parts by mass, based on 100 parts by mass of the toner particles. The inorganic fine particles may be of one kind, or may be a combination of multiple kinds.

Specific examples of the inorganic fine particles include silica, alumina, titanium oxide, barium titanate, calcium titanate, strontium titanate, cerium oxide, calcium carbonate, silicon carbide, and silicon nitride.

To suppress the deterioration of the fluidity and charge performance of the toner in high humidity, the inorganic fine particles are preferably subjected to a treatment for increasing hydrophobicity using a surface treatment agent.

Preferred examples of the surface treatment agent include a silane coupling agent, a silylation agent, a silane coupling agent having an alkyl fluoride group, an organic titanate coupling agent, an aluminum coupling agent, a silicone oil, and a modified silicone oil.

The black toner of the present invention may include the external additive (cleaning performance improver) for removing toner after transfer which remains on a photosensitive member or on a primary transfer medium. Examples of the cleaning performance improver include polymer fine particles produced by soap-free emulsion polymerization of a fatty acid metal salt (e.g., zinc stearate and calcium stearate), polymethyl methacrylate fine particles, and polystyrene fine particles.

Preferably, the above polymer fine particles exhibit a relatively narrow particle size distribution, and have a volume average particle size of 0.01 to 1 μm.

If the black toner according to the present invention is used in a two-component developer, the black toner may be mixed with a magnetic carrier. In such a case, the ratio of the toner in the developer is preferably 1 to 10 parts by mass based on 100 parts by mass of the magnetic carrier. As the magnetic carrier, an iron powder, ferrite powder, magnetite powder, magnetic resin carrier, or conventionally known product having an average particle size of 20 to 200 μm may be used.

The measurement methods of the various physical properties will now be described below.

<Method for Measuring Glass Transition Temperature Tg>

The method for measuring the Tg in the present invention was carried out under the following conditions using the DSC Q1000 (manufactured by TA Instruments).

(Measurement Conditions)

Modulation mode

Rate of temperature rise: 0.5° C./min or 4.0° C./min

Modulation temperature width: ±1.0° C./min

Measurement start temperature: 25° C.

Measurement finish temperature: 130° C.

A new measurement sample was prepared when changing the rate of temperature rise. Temperature increase was only carried out once. A DSC curve was plotted with the "Reversing Heat Flow" on the vertical axis. The onset values illustrated in FIG. 1 were taken as the Tg in the present invention.

<Method of Measuring Weight Average Particle Size (D4) and Number Average Particle Size (D1) of the Toner>

Using a precision particle size distribution measurement apparatus based on a pore electrical resistance method provided with a 100 μm aperture tube, the "Coulter Counter Multisizer 3", (registered trademark, manufactured by Beckman Coulter, Inc.), and the dedicated software included with the apparatus, "Beckman Coulter Multisizer 3 Version 3.51" (manufactured by Beckman Coulter, Inc.) for setting of the measurement conditions and analysis of the measurement data, measurement was performed with 25,000 effective measurement channels, and the measurement data was analyzed. Based on the analyzed data, the weight average particle size (D4) and the number average particle size (D1) of the toner were calculated.

As the electrolyte solution to be used in the measurement, a solution prepared by dissolving guaranteed reagent grade sodium chloride in ion-exchanged water to have a concentration of about 1 mass %, for example, an "Isoton II" (manufactured by Beckman Coulter, Inc.) can be used.

The dedicated software was set in the following manner prior to carrying out measurement and analysis.

In the "change standard operation method (SOM) screen" of the dedicated software, the total count number of control modes was set to 50,000 particles, the number of times of measurement was set to 1, and a value obtained by using "standard particles 10.0 μm" (manufactured by Beckman Coulter, Inc.) was set as a Kd value. A threshold and a noise level were automatically set by pressing a threshold/noise level measurement button. In addition, the current was set to 1,600 μA, gain was set to 2, the electrolyte solution was set to Isoton II, and a check mark was placed in flush aperture tube after measurement check box.

In the "setting for conversion from pulse to particle size screen" of the dedicated software, a bin interval was set to logarithmic particle size, the number of particle size bins was set to 256, and the particle size range was set to the range of 2 μm to 60 μm.

The specific measurement method is as follows.

(1) About 200 ml of the electrolyte solution was charged into a 250 ml round-bottom glass beaker designed for the Multisizer 3. The beaker was set in a sample stand, and the electrolyte solution in the beaker was stirred with a stirring rod at 24 rotations/sec in a counterclockwise direction. Then, dirt and air bubbles in the aperture tube were removed by the "aperture flush" function of the analysis software.

(2) About 30 ml of the electrolyte solution was charged into a 100 ml flat-bottom glass beaker. Then, the beaker was charged with, as a dispersant, about 0.3 ml of a diluted solution prepared by diluting "Contaminon N" (a 10 mass % aqueous solution of a neutral detergent for washing a precision measuring device, containing a nonionic surfactant, a cationic surfactant, and an organic builder, and having a pH of 7, which was manufactured by Wako Pure Chemical Industries, Ltd.) with ion-exchanged water by a factor of 3 in terms of mass.

(3) A predetermined amount of ion-exchanged water was charged into the water tank of an ultrasonic disperser "Ultrasonic Dispersion System Tetra 150" (manufactured by Nikkaki Bios, co. ltd.) in which two oscillators having an oscillating frequency of 50 kHz were installed so as to be out of phase by 180°, and which had an electrical output of 120 W. About 2 ml of the Contaminon N was added into the water tank.

(4) The beaker in the above section (2) was set in the beaker fixing hole of the ultrasonic disperser, and the ultrasonic disperser was operated. Then, the height position of the beaker was adjusted so that the liquid level of the electrolyte solution in the beaker can resonate to the fullest extent possible.

(5) About 10 mg of the toner was gradually charged into and dispersed in the electrolyte solution in the beaker from the above section (4) while irradiating the electrolyte solution with ultrasonic waves. Then, the ultrasonic dispersion treatment was continued for an additional 60 seconds. During the ultrasonic dispersion, the temperature of the water in the water tank was appropriately adjusted so as to be in the range of 10° C. or more to 40° C. or less.

(6) The electrolyte solution from the above section (5), in which the toner had been dispersed, was added dropwise with a pipette into the round-bottom beaker from the above section (1) placed in the sample stand. Then, the measurement concentration was adjusted to about 5%. Measurement was performed until the 50,000 particles were measured.

(7) The measurement data was analyzed with the dedicated software included with the apparatus, and the weight average particle size (D4) and the number average particle size (D1) were calculated. The "average size" on the analysis/volume statistics (arithmetic average) screen when the dedicated software was set to graph/vol % was the weight average particle size (D4), and the "average size" on the analysis/volume statistics (arithmetic average) screen when the dedicated software was set to graph/number % was the number average particle size (D1).

<Method for Measuring Particle Size of Resin Fine Particles and Wax Particles in Wax Dispersion>

The particle size of the resin fine particles and of the wax particles in the wax dispersion was measured using a microtrack particle size distribution measurement apparatus HRA (X-100) (manufactured by Nikkiso Co., Ltd.) with a range setting of 0.001 μm to 10 μm. The particle size was measured as the number average particle size (nm). Water was selected as the dilution solvent for the resin fine particles, and ethyl acetate was selected as the dilution solvent for the wax particles.

<Method of Measuring Resin Acid Value>

An acid value is the number of milligrams of potassium hydroxide needed for the neutralization of an acid in 1 g of a sample. The acid value of a resin is measured in conformance with JIS K 0070-1992. Specifically, the measurement is performed as follows.

(1) Preparation of Reagent 1.0 g of phenolphthalein is dissolved in 90 ml of ethanol (95 vol %). Ion-exchanged water is charged into the solution so that the mixture has a volume of 100 ml, whereby a phenolphthalein solution is obtained.

7 g of guaranteed reagent grade potassium hydroxide is dissolved in 5 ml of water. Ethyl alcohol (95 vol %) is charged into the solution so that the mixture has a volume of 1 l. The mixture is put in an alkali-resistant container and left to stand for 3 days so as not to be in contact with carbon dioxide gas and the like. The mixture is then filtered to obtain a potassium hydroxide solution. This potassium hydroxide solution is stored in an alkali-resistant container. The potassium hydroxide solution factor is determined by adding 25 ml of 0.1 mol/l hydrochloric acid into a conical flask, adding several drops of the above-described phenolphthalein solution, titrating with the potassium hydroxide solution, and then calculating the factor based on the amount of potassium hydroxide solution required for neutralization. The 0.1 mol/l hydrochloric acid was produced according to JIS K 8001-1998.

(2) Operation (A) Real Test 2.0 g of a pulverized sample of the binder resin is precisely weighed in a 200 ml conical flask, and 100 ml of a mixed solution of toluene and ethanol (2:1) is added to dissolve the sample over 5 hours. Subsequently, several drops of the phenolphthalein solution as an indicator are charged into the solution, and the solution is titrated using the potassium hydroxide solution. The end point of the titration is defined as when a faint red color of the indicator is exhibited for about 30 seconds.

(B) Blank Test

Titration is performed by the same operation as that described above, except that no sample is used (i.e., only the mixed solution of toluene and ethanol (2:1) is used).

(3) The acid value is calculated by substituting the obtained results into the following equation.

$$A=[(C-B)\times f\times 5.61]/S$$

A: Acid value (mgKOH/g)

B: Added amount (ml) of the potassium hydroxide solution in the blank test

C: Added amount (ml) of the potassium hydroxide solution in the real test f: Factor of the potassium hydroxide solution S: Mass (g) of the sample <Method for Measuring Resin Hydroxyl Group Value>

A hydroxyl group value is the number of milligrams of potassium hydroxide needed for the neutralization of ethyl acetate bonded with the hydroxyl group. The hydroxyl group value of the binder resin is measured in conformance with JIS K 0070-1992. More specifically, the measurement is carried out according to the following procedures.

(1) Preparation of Reagent 25 g of guaranteed reagent grade anhydrous ethyl acetate is charged into a 100 ml measuring flask. Pyridine is added so that the total is 100 ml. The mixture is mixed by thoroughly shaking to obtain an acetylated reagent. The obtained acetylated reagent is stored in a brown bottle so as not to come into contact with moisture, carbon dioxide gas and the like.

1.0 g of phenolphthalein is dissolved in 90 ml of ethyl alcohol (95 vol %). Ion-exchanged water is charged into the solution so that the mixture has a volume of 100 ml, whereby a phenolphthalein solution is obtained.

35 g of guaranteed reagent grade potassium hydroxide is dissolved in 20 ml of water. Ethyl alcohol (95 vol %) is charged into the solution so that the mixture has a volume of 1 l. The mixture is put in an alkali-resistant container and left to stand for 3 days so as not to be in contact with carbon dioxide gas and the like. The mixture is then filtered to obtain a potassium hydroxide solution. This potassium hydroxide solution is stored in an alkali-resistant container. The potassium hydroxide solution factor is determined by adding 25 ml of 0.5 mol/l hydrochloric acid into a conical flask, adding several drops of the above-described phenolphthalein solution, titrating with the potassium hydroxide solution, and then calculating the factor based on the amount of potassium hydroxide solution required for neutralization. The 0.5 mol/l hydrochloric acid was produced according to JIS K 8001-1998.

(2) Operation (A) Real Test 1.0 g of a pulverized sample of the binder resin is precisely weighed in a 200 ml round-bottomed flask, and 5.0 ml of the acetylated reagent are accurately charged into the flask using a whole pipette. At this stage, if the sample does not easily dissolve in the acetylated reagent, a small amount of guaranteed reagent grade toluene is added to dissolve the sample.

A small funnel is placed on the mouth of the flask. Approximately the bottom 1 cm portion of the flask is dipped in a glycerin bath of about 97° C., and heated. To prevent the temperature of the flask neck at this stage increasing from the heating, it is preferable to cover the base of the flask neck with a thick piece of paper in which a round hole is formed.

After 1 hour, the flask is removed from the glycerin bath and left to cool. Subsequently, 1 ml of water is added via the funnel, and the flask is then shaken to hydrolyze the anhydrous ethyl acetate. To completely hydrolyze the anhydrous ethyl acetate, the flask is again dipped in the glycerin bath and heated for 10 minutes. After being left to cool, the funnel and the walls of the flask are washed with 5 ml of ethyl alcohol.

Several drops of the above phenolphthalein are added as an indicator, and the mixture is titrated with the above potassium hydroxide solution. The end point of the titration is defined as when a faint red color of the indicator is exhibited for about 30 seconds.

(B) Blank Test

Titration is performed by the same operation as that described above, except that no binder resin sample is used.

(3) The hydroxyl group value is calculated by substituting the obtained results into the following equation.

$$A=[\{(B-C)\times 28.05\times f\}/S]+D$$

A: Hydroxyl group value (mg KOH/g)

B: Added amount (ml) of the potassium hydroxide solution in the blank test

C: Added amount (ml) of the potassium hydroxide solution in the real test f: Factor of the potassium hydroxide solution S: Sample (g)

D: Acid value of the binder resin (mg KOH/g)

<Method for Measuring Light Absorbance Per Unit Concentration of Toner>

The light absorbance per unit concentration of the toner was measured by the following method.

(1) Calculation of [A600/Cb1]

50 mg of toner was weighed, and added into 50 ml of ethyl acetate by a pipette to dissolve. The resultant solution was diluted by a factor of 5 with ethyl acetate to obtain a 0.2 mg/ml solution of toner in ethyl acetate. This solution of toner in ethyl acetate was used as a sample for light absorbance measurement.

In the measurement, the light absorbance of the solution was measured in the wavelength range of 350 nm to 800 nm using a quartz cell with a light path length of 10 mm, using the ultraviolet-visible spectrophotometer V-500V (manufactured by Jasco Corporation). The light absorbance A600 at a wavelength of 600 nm was measured. Light absorbance per unit concentration (mg/ml) was calculated by dividing the obtained light absorbance by the concentration of the toner in the ethyl acetate solution. The calculated value was used as [A600/Cb1].

(2) Calculation of [A600/Cb2]

50 mg of toner was weighed, and added into 50 ml of chloroform by a pipette to dissolve. The resultant solution was diluted by a factor of 5 with chloroform to obtain a 0.2 mg/ml solution of toner in chloroform. This solution of toner in chloroform was used as a sample for light absorbance measurement.

In the measurement, the light absorbance of the solution was measured in the wavelength range of 350 nm to 800 nm using a quartz cell with a light path length of 10 mm, using the ultraviolet-visible spectrophotometer V-500V (manufactured by Jasco Corporation). The light absorbance A600 at a wavelength of 600 nm was measured. Light absorbance per unit concentration (mg/ml) was calculated by dividing the obtained light absorbance by the concentration of the toner in the chloroform solution. The calculated value was used as [A600/Cb2].

<Method for Measuring Toner Dielectric Loss Tangent (tan δ) Represented by Dielectric Loss ε"/Dielectric Loss ε'>

The dielectric loss tangent (tan δ) represented by dielectric loss ε"/dielectric loss ε' was calculated from the measurement value of the complex dielectric constant at a frequency of 100,000 Hz after correction at frequencies of 1,000 Hz and 1 MHz using a 4284 Precision LCR Meter (manufactured by Hewlett-Packard).

More specifically, 1.0 g of toner was weighed, and molded while applying a load of 19,600 kPa (200 kgf/cm$^2$) to prepare a disc-shaped measurement sample having a diameter of 25 mm and a thickness of 2 mm or less (preferably 0.5 mm or more to 1.5 mm or less). This measurement sample was mounted on an ARES (manufactured by Rheometrics Scientific F.E.) which had a dielectric constant measurement jig (electrode). The dielectric loss tangent (tan δ=dielectric loss ε"/dielectric loss ε') was calculated by measuring the complex dielectric constant of the measurement sample in the frequency range of 1,000 Hz to 1 MHz. The dielectric loss tangent (tan δ) was determined as the value at the frequency of 100,000 Hz.

<Method for Measuring Toner Volume Resistivity>

Figure 4:
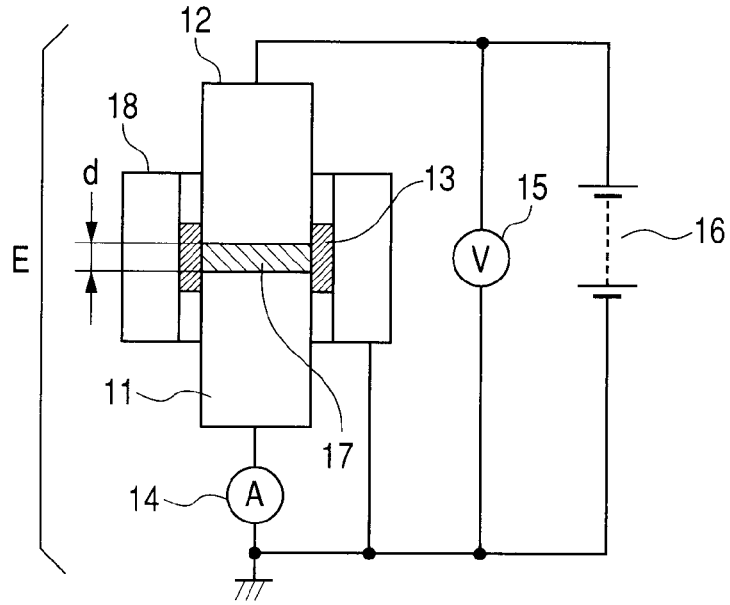
FIG. 4 is a schematic diagram of a measurement apparatus for determining the volume resistivity of a toner.

The volume resistivity of the toner was measured using the measurement apparatus illustrated in FIG. 4.

Specifically, the toner was filled into a resistivity measurement cell E. A lower electrode 11 and an upper electrode 12 were arranged so as to contact the toner, and a voltage was applied between these electrodes. The current flowing at this stage was measured to determine the volume resistivity. The measurement conditions are as follows.

Contact Area Between the Filled Toner and the Electrodes: S=About 2.3 $cm^2$

Thickness d: About 0.5 mm

Load on upper electrode 12: 180 g

Applied voltage: 500 V

<Method for Measuring Carbon Black Number Average Dispersion Diameter in Toner Particle>

Toner particles dispersed in a water-soluble resin were charged into a cryomicrotome apparatus (Ultracut N FC4E, manufactured by Reichert, Inc.). The apparatus was cooled to −80° C. with liquid nitrogen, whereby the water-soluble resin in which the toner particles were dispersed was frozen. The frozen water-soluble resin was trimmed with a glass knife so that a cutting surface had a width of about 0.1 mm and a length of about 0.2 mm. Next, using a diamond knife, an extremely thin section (thickness setting: 70 nm) of the toner containing the water-soluble resin was produced and moved onto a grid mesh for TPM observation using an eyelash probe. The temperature of the extremely thin section of the toner particle containing the water-soluble resin was returned to room temperature. After that, the water-soluble resin was dissolved in pure water for use as an observation sample for a transmission electron microscope (TEM). The sample was observed using the transmission electron microscope H-7500 (manufactured by Hitachi, Ltd.), at an accelerating voltage of 100 kV, and an enlarged photograph of a section of the toner particle was taken. The section of the toner particle was arbitrary selected. In addition, the magnification of the enlarged photograph was 10,000 times.

The photographed image was read at 600 dpi through an interface and input into the image analyzer Win ROOF Version 5.0 (manufactured by Microsoft-Mitani Corporation), for conversion into binary image data. In the data, only data regarding the carbon black particle was analyzed randomly. An agglomeration diameter of the carbon black particle was determined by repeating the measurements until the sampling number reached 100. The number average thereof was defined as the number average dispersion diameter of the carbon black present in the toner particle.

<Method for Measuring Amount of Water Absorption of Toner and Resin Under Environment of Temperature of 40° C. and Humidity of 95% RH>

(Sample Preparation)

A dried toner is used. The resin (a) and resin (b) were pulverized to a center diameter of 10 μm. Dried products of these are used. While a known means may be employed for the pulverizing, the cryogenic crusher JFC-300 manufactured by Japan Analytical Industry Co., Ltd. may be used.

(Measurement of Amount of Water Absorption)

The amount of water absorption of the sample under an environment of a temperature of 40° C. and a humidity of 95% RH is measured using the moisture sorption analyzer Q5000 SA manufactured by TA Instruments. Although an outline of the measurement is described in the operation manual "Q Series Start-Up Guide" published by TA Instruments (Revision B, published February 2006), the measurement is carried out as follows.

An empty pan is set in both the Q5000 SA reference chamber and sample chamber, and a zero adjustment is carried out. The sample is then charged into the sample side pan, and measurement is started.

<Measurement Conditions>

Apparatus: Q5000 SA manufactured by TA Instruments

Pan: Quartz-deposited Pan 957210.903 for Q5000 SA

Gas: Dry air

Sample amount: 1 to 2 mg

Humidity Program:

Step 1) Temperature 40° C., humidity 0% RH for 30 minutes

Step 2) Temperature 40° C., humidity 95% RH for 60 minutes

Step 3) Temperature 40° C., humidity 0% RH for 30 minutes (Analysis)

Figure 2:
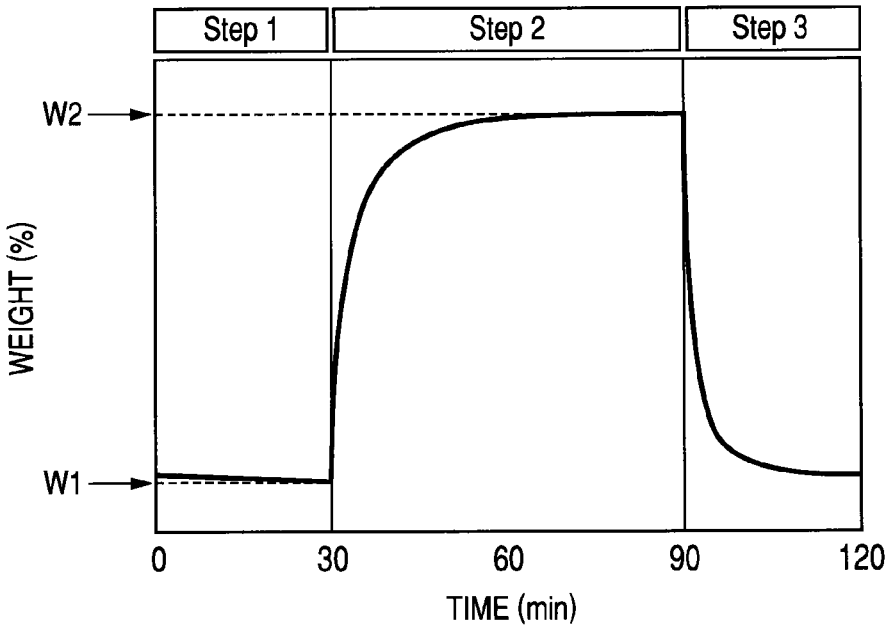
FIG. 2 is a diagram of measurement results of the amount of water absorption.

The chart illustrated in FIG. 2 was obtained, and analysis was performed as follows.

A value obtained by subtracting the weight (%) (W1) at the end of step 1 (30 minutes from measurement start) from the weight (%) (W2) at the end of step 2 (90 minutes from measurement start) is taken as the amount of water absorption (mass %) of the sample under an environment of a temperature of 40° C. and a humidity of 95% RH.

<Method for Measuring Vb>

The method for producing the sample is described below. Dilute hydrochloric acid is added dropwise to 50 mL of a resin fine particle dispersion obtained in the examples to adjust to a pH of 1. The formed precipitate is collected. 30 mL of tetrahydrofuran is added to the collected precipitate to dissolve it. Then, the resultant solution is charged with 200 mL of ion-exchanged water. The formed precipitate is collected and dried to obtain a resin.

(1) Preparation of Reagent 1.0 g of phenolphthalein is dissolved in 90 mL of ethyl alcohol (95 vol %). Ion-exchanged water is charged into the solution so that the mixture has a volume of 100 mL, whereby a "phenolphthalein solution" is obtained.

7 g of guaranteed reagent grade potassium hydroxide is dissolved in 5 ml of water. Ethyl alcohol (95 vol %) is charged into the solution so that the mixture has a volume of 1 L. The mixture is put in an alkali-resistant container and left to stand for 3 days so as not to be in contact with carbon dioxide gas and the like. The mixture is then filtered to obtain a "potassium hydroxide solution". This potassium hydroxide solution is stored in an alkali-resistant container. Standardization is carried out according to JIS K 0070-1996.

(2) Titration (A) Real Test 0.5 g of the above-described resin is precisely weighed in a 100 ml conical flask, and 12.5 mL of tetrahydrofuran is added to dissolve the resin. Subsequently, 5 drops of the phenolphthalein solution as an indicator are charged into the solution, and the solution is titrated using the potassium hydroxide solution. The end point of the titration is defined as when a faint red color of the indicator is exhibited for about 10 seconds.

(B) Blank Test

Titration is performed by the same operation as that described above, except that no sample is used.

(3) Vb is calculated by substituting the obtained results into the following equation.

$$Vb=[(B-C)\times f\times 5.61]/W$$

Vb: Acid value of the solution of the urethane resin (b) in tetrahydrofuran (mg KOH/g)

B: Added amount (mL) of the potassium hydroxide solution in the blank test

C: Added amount (mL) of the potassium hydroxide solution in the real test f: Factor of the potassium hydroxide solution W: Sample (g)

<Method for Determining Total Number of Moles [OH] of Diol Component Constituting Urethane Resin (b) and Total Number of Moles [NCO] of Isocyanate Component>

[OH] is determined by first dividing the mass of each diol component by its molecular weight to calculate the number of moles, and taking the sum thereof as [OH]. [NCO] is determined by first dividing the mass of each diisocyanate component by its molecular weight to calculate the number of moles, and taking the sum thereof as [NCO]. When using at this stage a diol component or a diisocyanate component having a molecular weight distribution, the number average molecular weight is used as the molecular weight used in the calculation of the number of moles.

<Method for Measuring Resin Softening Point (Tm)>

The softening point (Tm) of the resin was measured by a flow tester, which is a constant load extrusion capillary rheometer.

More specifically, the softening point (Tm) of the resin was measured using the elevated flow tester CFT500C manufactured by Shimadzu Corporation according to the following conditions. Based on the obtained data, a flow tester curve was produced (illustrated in FIGS. 3A and 3B). The softening point (Tm) of the resin was determined based on the figures.

Figure 3A:
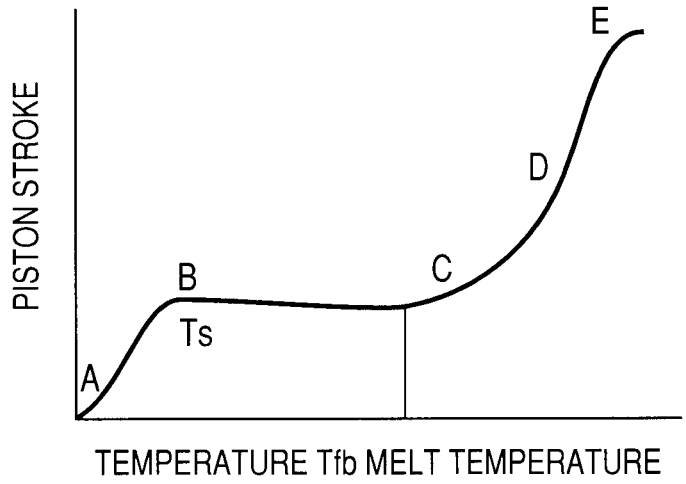
FIGS. 3A and 3B illustrate a flow curve based on data from a flow tester.
Figure 3B:
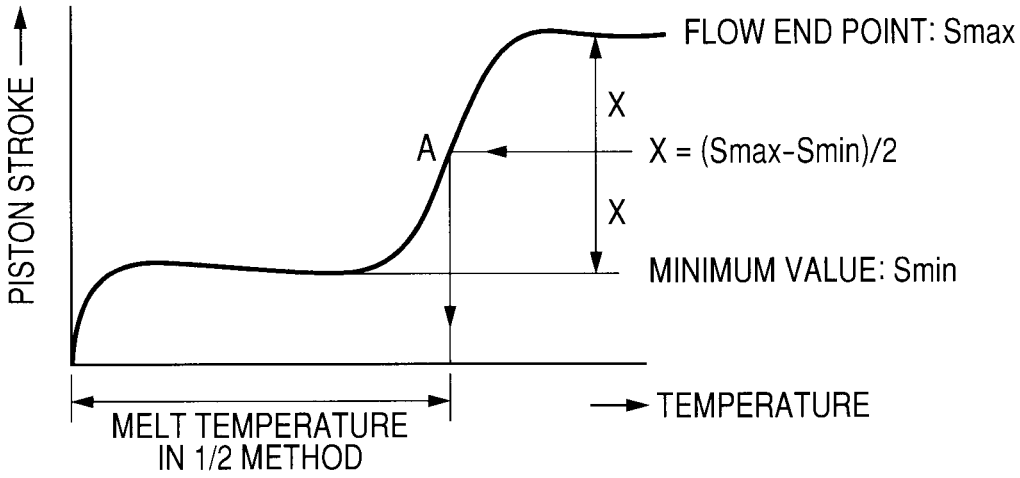

In FIGS. 3A and 3B, Tfb (flow starting temperature) is defined as the softening point (Tm).

<Measurement Conditions>

Load: 10 kgf/cm$^2$ (9.807×10$^5$ Pa)

Rate of temperature rise: 4.0° C./min

Die diameter: 1.0 mm

Die length: 1.0 mm

EXAMPLES

The present invention will now be described in more detail using the following examples. However, the present invention is in no way limited to these examples. Parts in the formulation described below are parts by mass unless otherwise described.

<Preparation of Resin Fine Particle Dispersion 1>

The following materials were charged into a reaction apparatus equipped with a stirrer and a thermometer while introducing a nitrogen gas.

| | |
|---|---|
| Polyester resin obtained from isophthalic acid and a propylene oxide 3 mole adduct of bisphenol A (number average molecular weight 1,000, hydroxyl group value 260 mgKOH/g) | 73 parts by mass |
| 2,2-Dimethylolpropionic acid | 5 parts by mass |
| Isophorone diisocyanate | 22 parts by mass |
| Triethylamine (urethanization reaction catalyst) | 0.5 parts by mass |
| Absolute acetone (solvent) | 100 parts by mass |

The resultant mixture was heated to 50° C., and a urethanization reaction was carried out over 15 hours to prepare a solution of a urethane resin with terminal hydroxyl groups. The isocyanate group content after the urethanization reaction finished was 0%. The solution was cooled to 40° C. To neutralize the carboxyl groups of the 2,2-dimethylolpropanoic acid, in addition to the already-added amount, an extra 3.2 parts by mass of triethylamine was added and mixed into the solution, whereby a reaction mixture was obtained. A part of the reaction mixture was dried to obtain a urethane resin (b)-1. The physical properties of urethane resin (b)-1 are illustrated in Table 1.

This reaction mixture was emulsified by charging it into 600 parts by mass of water while stirring with a TK homomixer manufactured by Primix Corporation at 10,000 rpm. The resultant mixture was diluted with water to have a solid content of 20 mass %, whereby a dispersion containing resin fine particles 1, which was a polyester-containing urethane emulsion, was obtained.

<Preparation of Resin Fine Particle Dispersion 2>

The following materials were charged into a reaction apparatus equipped with a stirrer and a thermometer while introducing a nitrogen gas.

| | |
|---|---|
| Polyester resin obtained from isophthalic acid and a propylene oxide 2 mole adduct of bisphenol A (number average molecular weight 2,000, hydroxyl group value 210 mgKOH/g) | 79 parts by mass |
| Neopentyl glycol | 1.5 parts by mass |
| 2,2-ethylolmethylolpropionic acid | 4 parts by mass |
| Isophorone diisocyanate | 14.5 parts by mass |
| Triethylamine (urethanization reaction catalyst) | 0.5 parts by mass |
| Absolute acetone (solvent) | 100 parts by mass |

The resultant mixture was heated to 50° C., and a urethanization reaction was carried out over 15 hours to prepare a solution of a urethane resin with terminal hydroxyl groups. The isocyanate group content after the urethanization reaction finished was 0%. The solution was cooled to 40° C. To neutralize the carboxyl groups of the 2,2-dimethylolpropanoic acid, in addition to the already-added amount, extra 4 parts by mass of triethylamine was added and mixed into the solution, whereby a reaction mixture was obtained. A part of the reaction mixture was dried to obtain a urethane resin (b)-2. The physical properties of urethane resin (b)-2 are illustrated in Table 1.

This reaction mixture was emulsified by charging it into 600 parts by mass of water while stirring with a TK homomixer manufactured by Primix Corporation at 10,000 rpm. The resultant mixture was diluted with water to have a solid content of 20 mass %, whereby a dispersion containing resin fine particles 2, which was a polyester-containing urethane emulsion, was obtained.

<Production of Resin Fine Particle Dispersion 3>

An autoclave equipped with a thermometer and a stirrer was charged with the following.

| | |
|---|---|
| Dimethyl terephthalate | 116 parts by mass |
| Dimethyl isophthalate | 66 parts by mass |
| 5-Sodium sulfoisophthalate methylester | 3 parts by mass |
| Trimellitic anhydride | 5 parts by mass |
| Propylene glycol | 150 parts by mass |
| Tetrabutoxy titanate | 0.1 parts by mass |

The resultant mixture was heated at 200° C. for 120 minutes to carry out an ester exchange reaction. Next, the temperature of the reaction system was increased to 220° C., and the reaction was continued for 60 minutes with the pressure of the system set to 1 to 10 mmHg to obtain a polyester resin.

40 parts by mass of the polyester resin was dissolved in 15 parts by mass of methyl ethyl ketone and 10 parts by mass of tetrahydrofuran at 80° C. Then, 60 parts by mass of water was added at 80° C. while stirring, and the solvent was removed under reduced pressure. Ion-exchanged water was then added to the resultant mixture, whereby resin fine particles dispersion 3 having a solid content of 20 mass % was obtained. The properties of the resin obtained by drying the resin fine particle dispersion 3 are illustrated in Table 1.

<Production of Resin Fine Particle Dispersion 4>

The following materials were charged into a reaction vessel equipped with a cooling pipe, a nitrogen introduction pipe, and a stirrer to obtain a composition.

| | |
|---|---|
| Styrene | 330 parts by mass |
| n-Butyl acrylate | 110 parts by mass |
| Acrylic acid | 10 parts by mass |
| 2-Butanone (solvent) | 50 parts by mass |

8 Parts by weight of 2,2'-azobis(2,4-dimethylvaleronitrile) as a polymerization initiator was dissolved into the above composition to prepare a polymerizable monomer composition. The polymerizable monomer composition was polymerized for 8 hours at 60° C. The temperature of the system was then increased to 150° C., and the solvent was removed under reduced pressure. The reaction product was removed from the reaction vessel and allowed to cool to room temperature. The mixture was then pulverized into particles, whereby a linear vinyl resin was obtained. 100 Parts by mass of this resin and 400 parts by mass of toluene were mixed together. The resultant mixture was heated to 80° C. to dissolve the resin, whereby a resin solution was obtained.

Next, 360 parts by mass of ion-exchanged water and 40 parts by mass of aqueous 48.5% sodium dodecyl diphenyl ether disulfonate (Eleminol MON-7, manufactured by Sanyo Chemical Industries, Ltd.) were mixed together. The resultant mixture was charged with the above resin solution. The mixture was stirred and mixed, whereby a milky white liquid was obtained. The toluene was then removed under reduced pressure. Ion-exchanged water was added, whereby a resin fine particle dispersion 4 with a solid content of 20 mass % was obtained. The properties of the resin obtained by drying the resin fine particle dispersion 4 are illustrated in Table 1.

<Preparation of Resin Fine Particle Dispersion 5>

The following materials were charged into a reaction apparatus equipped with a stirrer and a thermometer while introducing a nitrogen gas.

| | |
|---|---|
| Ethylene oxide 2 mole adduct of bisphenol A (hydroxyl group value 310 mgKOH/g) | 60 parts by mass |
| Neopentyl glycol | 1 part by mass |
| 2,2-Dimethylolpropionic acid | 12 parts by mass |
| Isophorone diisocyanate | 27 parts by mass |
| Triethylamine (urethanization reaction catalyst) | 0.5 parts by mass |
| Absolute acetone (solvent) | 100 parts by mass |

The resultant mixture was heated to 50° C., and a urethanization reaction was carried out over 15 hours to prepare a solution of a urethane resin with terminal hydroxyl groups. The isocyanate group content after the urethanization reaction finished was 0%. The solution was cooled to 40° C. To neutralize the carboxyl groups of the 2,2-dimethylolpropanoic acid, in addition to the already-added amount, an extra 1.7 parts by mass of triethylamine was added and mixed into the solution, whereby a reaction mixture was obtained. A part of the reaction mixture was dried to obtain a urethane resin (b)-3. The physical properties of urethane resin (b)-3 are illustrated in Table 1.

This reaction mixture was emulsified by charging it into 600 parts by mass of water while stirring with a TK homomixer manufactured by Primix Corporation at 10,000 rpm. The resultant mixture was diluted with water to have a solid content of 20 mass %, whereby a dispersion containing resin fine particles 5, which was a polyester-containing urethane emulsion, was obtained was obtained.

<Preparation of Resin Fine Particle Dispersion 6>

The following materials were charged into a reaction apparatus equipped with a stirrer and a thermometer while introducing a nitrogen gas.

| | |
|---|---|
| Polyester resin obtained from isophthalic acid and a propylene oxide 3 mole adduct of bisphenol A (number average molecular weight 1,000, hydroxyl group value 260 mgKOH/g) | 54.5 parts by mass |
| 2,2-Dimethylolpropionic acid | 10.5 parts by mass |
| Isophorone diisocyanate | 35 parts by mass |
| Triethylamine (urethanization reaction catalyst) | 0.5 parts by mass |
| Absolute acetone (solvent) | 100 parts by mass |

The resultant mixture was heated to 50° C., and a urethanization reaction was carried out over 15 hours to prepare a solution of a urethane resin with terminal hydroxyl groups. The isocyanate group content after the urethanization reaction finished was 0%. The solution was cooled to 40° C. To neutralize the carboxyl groups of the 2,2-dimethylolpropanoic acid, in addition to the already-added amount, 4 parts by mass of triethylamine was added and mixed into the solution, whereby a reaction mixture was obtained. A part of the reaction mixture was dried to obtain a urethane resin (b)-4. The physical properties of urethane resin (b)-4 are illustrated in Table 1.

This reaction mixture was emulsified by charging it into 600 parts by mass of water while stirring with a TK homomixer manufactured by Primix Corporation at 10,000 rpm. The resultant mixture was diluted with water to have a solid content of 20 mass %, whereby a dispersion containing resin fine particles 6, which was a polyester-containing urethane emulsion, was obtained.

<Preparation of Resin Fine Particle Dispersion 7>

The following materials were charged into a reaction apparatus equipped with a stirrer and a thermometer while introducing a nitrogen gas.

| | |
|---|---|
| Polyester resin obtained from isophthalic acid and a propylene oxide 3 mole adduct of bisphenol A (number average molecular weight 1,000, hydroxyl group value 260 mgKOH/g) | 55 parts by mass |
| 2,2-Dimethylolpropionic acid | 15 parts by mass |
| Isophorone diisocyanate | 30 parts by mass |
| Triethylamine (urethanization reaction catalyst) | 0.5 parts by mass |
| Absolute acetone (solvent) | 100 parts by mass |

The resultant mixture was heated to 50° C., and a urethanization reaction was carried out over 15 hours to prepare a solution of a urethane resin with terminal hydroxyl groups. The isocyanate group content after the urethanization reaction finished was 0%. The solution was cooled to 40° C. To neutralize the carboxyl groups of the 2,2-dimethylolpropanoic acid, in addition to the already-added amount, an extra 22.8 parts by mass of triethylamine was added and mixed into the solution, whereby a reaction mixture was obtained. A part of the reaction mixture was dried to obtain a urethane resin (b)-5. The physical properties of urethane resin (b)-5 are illustrated in Table 1.

This reaction mixture was emulsified by charging it into 600 parts by mass of water while stirring with a TK homomixer manufactured by Primix Corporation at 10,000 rpm. The resultant mixture was diluted with water to have a solid content of 20 mass %, whereby a dispersion containing resin fine particles 7, which was a polyester-containing urethane emulsion, was obtained.

<Preparation of Resin Fine Particle Dispersion 8>

The following materials were charged into a reaction apparatus equipped with a stirrer and a thermometer while introducing a nitrogen gas.

| | |
|---|---|
| Polyester resin obtained from isophthalic acid and a propylene oxide 3 mole adduct of bisphenol A (number average molecular weight 1,000, hydroxyl group value 260) | 80 parts by mass |
| Neopentyl glycol | 1 part by mass |
| 2,2-Dimethylolpropionic acid | 2 parts by mass |
| Isophorone diisocyanate | 15 parts by mass |
| Triethylamine (urethanization reaction catalyst) | 0.5 parts by mass |
| Absolute acetone (solvent) | 100 parts by mass |

The resultant mixture was heated to 50° C., and a urethanization reaction was carried out over 15 hours to prepare a solution of a urethane resin with terminal hydroxyl groups. The isocyanate group content after the urethanization reaction finished was 0%. The solution was cooled to 40° C. To neutralize the carboxyl groups of the 2,2-dimethylolpropanoic acid, in addition to the already-added amount, an extra 22.8 parts by mass of triethylamine was added and mixed into the solution, whereby a reaction mixture was obtained. A part of the reaction mixture was dried to obtain a urethane resin (b)-6. The physical properties of urethane resin (b)-6 are illustrated in Table 1.

This reaction mixture was emulsified by charging it into 600 parts by mass of water while stirring with a TK homomixer manufactured by Primix Corporation at 10,000 rpm. The resultant mixture was diluted with water to have a solid content of 20 mass %, whereby a dispersion containing resin fine particles 8, which was a polyester-containing urethane emulsion, was obtained.

<Preparation of Polyester 1>

The following materials were charged into a reaction vessel equipped with a cooling pipe, a nitrogen introduction pipe, and a stirrer.

| | |
|---|---|
| 1,8-Octanediol | 1,505 parts by mass |
| Dimethyl ester terephthalate | 776 parts by mass |
| 1,6-Hexanedioic acid | 292 parts by mass |
| Tetrabutoxy titanate (condensation catalyst) | 3 parts by mass |

The resultant mixture was reacted at 160° C. for 8 hours in a stream of nitrogen while generated methanol was distilled off. Next, the temperature of the resultant product was increased gradually to 210° C. The product was then reacted for 4 hours in a stream of nitrogen, while the generated dialcohol and water were distilled off. The resultant product was further reacted for 1 hour under a reduced pressure of 20 mmHg and then cooled to 160° C. 120 Parts by mass of trimellitic anhydride and 125 parts by mass of 1,3-propanedioic acid were added to the product, and the resultant mixture was reacted for 2 hours under sealing at normal pressure, followed by reacting at 200° C. at normal pressure. The resultant product was removed at the point when the softening point became 170° C. After cooling to room temperature, the removed resin was pulverized into particles, whereby polyester 1, which was a non-linear polyester resin, was obtained.

<Preparation of Polyester 2>

Polyester 2, which was a non-linear polyester resin, was obtained in the same manner as polyester 1, except that 1,550 parts by mass of 1,9-nonanediol was used instead of 1,8-octanediol.

<Preparation of Polyester 3>

Polyester 3, which was a non-linear polyester resin, was obtained in the same manner as polyester 1, except that 1,795 parts by mass of 1,10-decanediol was used instead of 1,8-octanediol.

TABLE 1

| | Resin Fine Particles | Vb | [NCO]/[OH] | Charge Amount of Carboxyl-Group-Containing Diol (parts by mass) | Charge Amount of Diisocyanate (parts by mass) | Amount of Water Absorption (mass %) | Softening Point | Number Average Particle Size in Dispersion (nm) |
|---|---|---|---|---|---|---|---|---|
| Resin Fine Particle Dispersion-1 | Urethane Resin (b)-1 (Urethane-1) | 20.5 | 0.90 | 5 | 22 | 1.1 | 140 | 55 |
| Resin Fine Particle Dispersion-2 | Urethane Resin (b)-2 (Urethane-2) | 18.0 | 0.78 | 4 | 14.5 | 0.9 | 140 | 55 |
| Resin Fine Particle Dispersion-3 | Polyester Resin (PES) | 41.0 | — | — | — | 0.5 | 107 | 90 |
| Resin Fine Particle Dispersion-4 | Linear Vinyl Resin (St-Ac) | 14.0 | — | — | — | 0.2 | 123 | 60 |
| Resin Fine Particle Dispersion-5 | Urethane Resin (b)-3 (Urethane-3) | 50.4 | 0.94 | 12 | 27 | 1.2 | 108 | 40 |
| Resin Fine Particle Dispersion-6 | Urethane Resin (b)-4 (Urethane-4) | 43.8 | 1.19 | 10.5 | 35 | 2.5 | 105 | 40 |
| Resin Fine Particle Dispersion-7 | Urethane Resin (b)-5 (Urethane-5) | 62.3 | 0.81 | 15 | 30 | 3.6 | 107 | 40 |
| Resin Fine Particle Dispersion-8 | Urethane Resin (b)-6 (Urethane-6) | 8.8 | 0.65 | 2 | 15 | 0.8 | 108 | 40 |

<Preparation of Polyester 4>

Polyester 4, which was a non-linear polyester resin, was obtained in the same manner as polyester 1, except that 928 parts by mass of 1,4-butanediol was used instead of 1,8-octanediol.

<Preparation of Polyester 5>

Polyester 5, which was a non-linear polyester resin, was obtained in the same manner as polyester 1, except that 536 parts by mass of 1,5-pentanediol and 392 parts by mass of propylene glycol were used instead of 1,8-octanediol.

<Preparation of Polyester 6>

Polyester 6, which was a non-linear polyester resin, was obtained in the same manner as polyester 1, except that 2,082 parts by mass of 1,12-dodecanediol was used instead of 1,8-octanediol.

<Preparation of Polyester 7>

The following materials were charged into a reaction vessel equipped with a cooling pipe, a nitrogen introduction pipe, and a stirrer.

| | |
|---|---|
| 1,3-Butanediol | 1,036 parts by mass |
| Dimethyl terephthalate | 892 parts by mass |
| 1,6-Hexanedioic acid | 205 parts by mass |
| Tetrabutoxy titanate (condensation catalyst) | 3 parts by mass |

The resultant mixture was reacted at 180° C. for 8 hours in a stream of nitrogen while generated methanol was distilled off. Next, the temperature of the resultant product was increased gradually to 230° C. The product was then reacted for 4 hours in a stream of nitrogen, while the generated dialcohol and water were distilled off. The resultant product was further reacted for 1 hour under a reduced pressure of 20 mmHg and then cooled to 160° C. 120 Parts by mass of trimellitic anhydride and 125 parts by mass of 1,3-propanedioic acid were added to the product, and the resultant mixture was reacted for 2 hours under sealing at normal pressure, followed by reacting at 200° C. at normal pressure. The resultant product was removed at the point when the softening point became 170° C. After cooling to room temperature, the removed resin was pulverized into particles, whereby polyester 7, which was a linear polyester resin, was obtained.

<Preparation of Polyester 8>

The following materials were charged into a reaction vessel equipped with a cooling pipe, a nitrogen introduction pipe, and a stirrer.

| | |
|---|---|
| 1,8-Octanediol | 1,505 parts by mass |
| Dimethyl terephthalate | 776 parts by mass |
| 1,6-Hexanedioic acid | 292 parts by mass |
| Tetrabutoxy titanate (condensation catalyst) | 3 parts by mass |

The resultant mixture was reacted at 160° C. for 8 hours in a stream of nitrogen while generated methanol was distilled off. Next, the temperature of the resultant product was increased gradually to 210° C. The product was then reacted for 4 hours in a stream of nitrogen, while the generated dialcohol and water were distilled off. The resultant product was further reacted for 1 hour under a reduced pressure of 20 mmHg and then cooled to 160° C. 120 Parts by mass of trimellitic anhydride and 125 parts by mass of 1,3-propanedioic acid were added to the product, and the resultant mixture was reacted for 2 hours under sealing at normal pressure, followed by reacting at 200° C. at normal pressure. The resultant product was removed at the point when the softening point became 180° C. After cooling to room temperature, the removed resin was pulverized into particles, whereby polyester 8, which was a non-linear polyester resin, was obtained.

<Preparation of Polyester 9>

The following materials were charged into a reaction vessel equipped with a cooling pipe, a nitrogen introduction pipe, and a stirrer.

| | |
|---|---|
| 1,2-Propanediol | 799 parts by mass |
| Dimethyl terephthalate | 892 parts by mass |
| 1,6-Hexanedioic acid | 205 parts by mass |
| Tetrabutoxy titanate (condensation catalyst) | 3 parts by mass |

The resultant mixture was reacted at 180° C. for 8 hours in a stream of nitrogen while generated methanol was distilled off. Next, the temperature of the resultant product was increased gradually to 230° C. The product was then reacted for 4 hours in a stream of nitrogen, while the generated dialcohol and water were distilled off. The resultant product was further reacted for 1 hour under a reduced pressure of 20 mmHg and then cooled to 160° C. 120 Parts by mass of trimellitic anhydride was added to the product, and the resultant mixture was reacted for 2 hours under sealing at normal pressure, followed by reacting at 220° C. at normal pressure. The resultant product was removed at the point when the softening point became 170° C. After cooling to room temperature, the removed resin was pulverized into particles, whereby polyester 9, which was a non-linear polyester resin, was obtained.

<Preparation of Polyester 10>

The following materials were charged into a reaction vessel equipped with a cooling pipe, a nitrogen introduction pipe, and a stirrer.

| | |
|---|---|
| 1,14-Tetradecanediol | 2,330 parts by mass |
| Dimethyl terephthalate | 892 parts by mass |
| 1,6-Hexanedioic acid | 205 parts by mass |
| Tetrabutoxy titanate (condensation catalyst) | 3 parts by mass |

The resultant mixture was reacted at 180° C. for 8 hours in a stream of nitrogen while generated methanol was distilled off. Next, the temperature of the resultant product was increased gradually to 230° C. The product was then reacted for 4 hours in a stream of nitrogen, while the generated propyleneglycol and water were distilled off. The resultant product was further reacted for 1 hour under a reduced pressure of 20 mmHg and then cooled to 180° C. 120 Parts by mass of trimellitic anhydride was added to the product, and the resultant mixture was reacted for 2 hours under sealing at normal pressure, followed by reacting at 220° C. at normal pressure. The resultant product was removed at the point when the softening point became 180° C. After cooling to room temperature, the removed resin was pulverized into particles, whereby polyester 10, which was a non-linear polyester resin, was obtained.

<Preparation of Polyester 11>

The following materials were charged into a reaction vessel equipped with a cooling pipe, a nitrogen introduction pipe, and a stirrer.

| | |
|---|---|
| 1,8-Octanediol | 1,505 parts by mass |
| Dimethyl terephthalate | 776 parts by mass |
| 1,6-Hexanedioic acid | 292 parts by mass |
| Tetrabutoxy titanate (condensation catalyst) | 3 parts by mass |

The resultant mixture was reacted at 160° C. for 8 hours in a stream of nitrogen while generated methanol was distilled off. Next, the temperature of the resultant product was increased gradually to 210° C. The product was then reacted for 4 hours in a stream of nitrogen, while the generated dialcohol and water were distilled off. The resultant product was further reacted for 1 hour under a reduced pressure of 20 mmHg and then cooled to 160° C. 120 Parts by mass of trimellitic anhydride and 125 parts by mass of 1,3-propanedioic acid were added to the product, and the resultant mixture was reacted for 2 hours under sealing at normal pressure, followed by reacting at 200° C. at normal pressure. The resultant product was removed at the point when the softening point became 160° C. After cooling to room temperature, the removed resin was pulverized into particles, whereby polyester 11, which was a non-linear polyester resin, was obtained.

<Preparation of Polyester 12>

The following materials were charged into a reaction vessel equipped with a cooling pipe, a nitrogen introduction pipe, and a stirrer.

| | |
|---|---|
| 1,8-Octanediol | 1,505 parts by mass |
| Dimethyl terephthalate | 776 parts by mass |
| 1,6-Hexanedioic acid | 292 parts by mass |
| Tetrabutoxy titanate (condensation catalyst) | 3 parts by mass |

The resultant mixture was reacted at 160° C. for 8 hours in a stream of nitrogen while generated methanol was distilled off. Next, the temperature of the resultant product was increased gradually to 210° C. The product was then reacted for 4 hours in a stream of nitrogen, while the generated dialcohol and water were distilled off. The resultant product was further reacted for 1 hour under a reduced pressure of 20 mmHg and then cooled to 160° C. 150 Parts by mass of trimellitic anhydride and 125 parts by mass of 1,3-propanedioic acid were added to the product, and the resultant mixture was reacted for 2 hours under sealing at normal pressure, followed by reacting at 200° C. at normal pressure. The resultant product was removed at the point when the softening point became 190° C. After cooling to room temperature, the removed resin was pulverized into particles, whereby polyester 12, which was a non-linear polyester resin, was obtained.

<Preparation of Polyester Resin Solutions>

Ethyl acetate was charged into a closed vessel equipped with a stirring blade. Under stirring at 100 rpm, the polyesters 1 to 12 were added, and stirred for 3 days at room temperature, whereby polyester resin solutions 1 to 12 were prepared. The resin content of the polyester resin solutions 1 to 12 was 50 mass %. The properties of the polyesters 1 to 12 are illustrated in Table 2.

TABLE 2

| | Resin | Tg (° C.) | Acid Value (mgKOH/g) | Hydroxyl Group Value (mgKOH/g) | Amount of Water Absorption (mass %) |
|---|---|---|---|---|---|
| Polyester Resin Solution-1 | Polyester-1 | 41 | 17 | 52 | 1.0 |
| Polyester Resin Solution-2 | Polyester-2 | 36 | 16 | 76 | 1.1 |
| Polyester Resin Solution-3 | Polyester-3 | 53 | 18 | 27 | 0.8 |
| Polyester Resin Solution-4 | Polyester-4 | 43 | 20 | 17 | 1.1 |
| Polyester Resin Solution-5 | Polyester-5 | 42 | 18 | 60 | 1.6 |
| Polyester Resin Solution-6 | Polyester-6 | 45 | 9 | 82 | 0.5 |
| Polyester Resin Solution-7 | Polyester-7 | 40 | 15 | 50 | 1.0 |
| Polyester Resin Solution-8 | Polyester-8 | 60 | 13 | 32 | 0.9 |
| Polyester Resin Solution-9 | Polyester-9 | 55 | 32 | 85 | 2.2 |
| Polyester Resin Solution-10 | Polyester-10 | 47 | 7 | 42 | 0.4 |
| Polyester Resin Solution-11 | Polyester-11 | 32 | 17 | 72 | 1.6 |
| Polyester Resin Solution-12 | Polyester-12 | 62 | 8 | 16 | 0.8 |

<Preparation of Wax Dispersion 1>

| | |
|---|---|
| Carnaba wax (melting point 81° C.) | 20 parts by mass |
| Ethyl acetate | 80 parts by mass |

The above materials were charged into a glass beaker equipped with a stirring blade (manufactured by Iwaki Co., Ltd.), and the carnaba wax was dissolved in the ethyl acetate by heating the system to 70° C.

Next, the system was gradually cooled to 25° C. over 3 hours while gently stirring at 50 rpm to, whereby a milky-white liquid was obtained.

This solution and 20 parts by mass of 1-mm glass beads were charged into a heat-resistant vessel, and the resultant mixture was dispersed with a paint shaker (manufactured by Toyo Seiki Seisaku-sho, Ltd.) for 3 hours, whereby wax dispersion 1 was obtained.

The wax particle size in wax dispersion 1 was measured with a microtrack particle size distribution measurement apparatus HRA (X-100) (manufactured by Nikkiso Co., Ltd.), and the number average particle size was 0.15 μm.

<Preparation of Colorant Dispersion 1>

| | |
|---|---|
| Polyester 12 | 50 parts by mass |
| Carbon black 1 (specific surface area: 60 $m^2/g$, pH = 7.5, oil absorption: 82 ml/100 g, number average particle size of the primary particle: 35 nm) | |
| Ethyl acetate | 100 parts by mass |
| Glass beads (1 mm) | 100 parts by mass |

The above materials were charged into a heat resistant glass vessel and then dispersed for 5 hours by a paint shaker (manufactured by Toyo Seiki Seisaku-sho, Ltd.). Then, the glass beads were removed by a nylon mesh to obtain colorant dispersion 1.

<Preparation of Colorant Dispersions 2 to 11>

Colorant Dispersions 2 to 11 were obtained in the same manner as Colorant Dispersion 1, except that Polyesters 2 to 11 were respectively used instead of the Polyester 12 used in the prepared of Colorant Dispersion 1.

<Preparation of Colorant Dispersion 12>

| | |
|---|---|
| Polyester 12 | 40 parts by mass |
| Carbon black 1 | 60 parts by mass |
| Ethyl acetate | 100 parts by mass |
| Glass beads (1 mm) | 100 parts by mass |

The above materials were charged into a heat resistant glass vessel and then dispersed for 5 hours by a paint shaker (manufactured by Toyo Seiki). The glass beads were removed by a nylon mesh to obtain colorant dispersion 12.

<Preparation of Colorant Dispersion 13>

| | |
|---|---|
| Carbon black 1 | 100 parts by mass |
| Polyester 1 | 150 parts by mass |

The above materials were charged into a kneading-type mixer, and while mixing the materials, the temperature was increased without applying pressure. The temperature was increased to 130° C. The mixture was then heated and melt-kneaded for about 60 minutes to disperse the carbon black in the resin. The mixture was then cooled to obtain a kneaded product.

Next, the kneaded product was coarsely pulverized with a hammer, then ethyl acetate was mixed into the coarse particles so that the solid concentration was 50 mass %. Subsequently, using a disper, the mixture was stirred at 8,000 rpm for 10 minutes to obtain colorant dispersion 13.

Carrier Preparation Example

A magnetite powder having a number average particle size of 0.25 μm and a hematite powder having a number average particle size of 0.60 μm were each charged with 4.0 mass % of a silane coupling agent 3-(2-aminoethylaminopropyl)trimethoxysilane. The resultant mixtures were mixed and stirred at high speed in a vessel at 100° C. or more to subject the respective fine particles to a lipophilization treatment.

| | |
|---|---|
| Phenol | 10 parts by mass |
| Formaldehyde solution (formaldehyde 40%, methanol 10%, water 50%) | 6 parts by mass |
| Lipophilic-treated magnetite | 63 parts by mass |
| Lipophilic-treated hematite | 21 parts by mass |

The above materials, 5 parts by mass of 28% ammonia water, and 10 parts by mass of water were charged into a flask, and while stirring and mixing, these materials were heated to 85° C. for 30 minutes and held. The resultant mixture was then cured by carrying out a polymerization reaction for 3 hours. Thereafter, the reaction system was cooled to 30° C., and water was further added thereto. Then, the supernatant liquid was removed, and the sediment was washed with water and air-dried. Subsequently, the resultant product was dried at 60° C. under reduced pressure (5 mmHg or less) to obtain spherical magnetic resin particles with magnetic particles dispersed therein.

A copolymer of methyl methacrylate and methyl methacrylate having a perfluoroalkyl group (m=7) (copolymerization ratio 8:1, weight average molecular weight 45,000) was used as a coating resin. 10 Parts by mass of melamine particles having a number average particle size of 290 nm and 6 parts by mass of carbon particles having a resistivity of $1\times10^{-2}$ Ω·cm and a number average particle size of 30 nm) were mixed into 100 parts by mass of the coating resin. The resultant mixture was dispersed by an ultrasonic disperser for 30 minutes. Further, a coating solution of a mixed dispersion in methyl ethyl ketone and toluene was prepared so that, based on 100 parts by mass of the carrier core, the coating resin was 2.5 parts by mass (solution concentration 10 mass %).

While continuously applying a shear stress to this coating fluid, the solvents were evaporated off at 70° C. to coat the resin on the surface of the magnetic resin particles. The thus resin-coated magnetic carrier particles were heat treated while stirring at 100° C. for 2 hours, cooled, and then disintegrated. Subsequently, the resultant particles were classified using a 200 mesh (aperture 75 μm) sieve to obtain a carrier having a number average particle size of 33 μm, a specific true specific gravity of 3.53 g/cm$^3$, an apparent specific gravity of 1.84 g/cm$^3$ and a magnetization intensity of 42 Am$^2$/kg.

Example 1

Preparation of Oil Phase

| | |
|---|---|
| Wax dispersion 1 | 50 parts by mass |
| Colorant dispersion 1 | 40 parts by mass |
| Polyester resin solution 1 | 128 parts by mass |
| Polyester resin solution 12 | 12 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase 1.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 1 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

(Emulsifying and Desolvating Steps)

The oil phase was charged into the aqueous phase, and the resultant mixture was stirred continuously for 3 minutes by a TK-homomixer at a step of up to 8,000 rpm, whereby the oil phase 1 was suspended.

Next, a stirring blade was set in the vessel, and desolvation was carried out over 5 hours by increasing the temperature in the system increased to 50° C. while stirring at 200 rpm, and with a pressure reduced to 500 mmHg, whereby an aqueous dispersion of toner particles was obtained.

(Washing and Drying Step)

The above aqueous dispersion of toner particles was filtered, and the filtrate was charged into 500 parts by mass of ion-exchanged water to form a reslurry. Then, hydrochloric acid was added to the system until the pH was 4. The mixture was then stirred for 5 minutes.

The above slurry was filtered again, 200 parts by mass of ion-exchanged water were added to the filtrate, and the mixture was stirred for 5 minutes. This series of operations was repeated three times to remove triethylamine remaining in the system, whereby a filtered cake of the toner particles was obtained. This filtered cake was dried with a warm air dryer at 45° C. for 3 days and sieved with a mesh having an aperture of 75 μm to obtain toner particles 1.

(Preparation of Toner)

Based on 100 parts by mass of the above toner particles 1, 0.7 parts by mass of hydrophobic silica with a number average size of 20 nm and 0.8 parts by mass of monodisperse silica with a number average size of 120 nm were mixed by a Henschel mixer FM-10B (manufactured by Mitsui Miike Machinery Co., Ltd.) to obtain a toner 1.

The toner formulation is illustrated in Table 3, and the toner characteristics are illustrated in Table 4.

Next, two-component developer 1 was prepared by mixing 8 parts by mass of this toner 1 and 92 parts by mass of the above-described carrier. Then, using this two-component developer, the following evaluations were carried out. The evaluation results are illustrated in Table 5.

The method for evaluating the above-described two-component developer using an image forming apparatus will now be described. Using a modified (evaluation machine) full-color copying machine CLC 5000 manufactured by Canon Inc. for the evaluation, the following evaluations were performed. Below, unless noted otherwise, measurements were carried out under an ordinary-temperature, ordinary-humidity environment (23° C./60% RH). Further, the modifications made to the copying machine were the following (1) and (2). (1) Using a 655 nm semiconductor laser, the spot diameter was narrowed to enable output at 1,200 dpi. (2) The surface layer of the fixing roller of the fixing unit was change to a silicone tube, and the oil coating mechanism was removed.

<Reflection Density>

Using the above-described evaluation machine, the toner load in a solid image on a sheet of Canon Inc. color laser copier paper was adjusted to 0.35 mg/cm$^2$, and a post-fixing image was produced. The density of the produced image was evaluated using a reflection densitometer manufactured by X-rite (500 Series Spectrodensitometer).

(Evaluation Criteria)

A: Reflection density of 1.50 or more, and sufficient black density could be obtained.

B: Reflection density of 1.40 or more to less than 1.50, and a slightly inferior black density.

C: Reflection density of less than 1.40 and a low black density.

<Blank Fogging>

The density of a post-fixing image portion was adjusted by the above evaluation machine so as to have a toner load of 1.4. The potential on the photosensitive member was adjusted from the development bias so that the blank portion potential was 150 V in the direction opposite to the image portion. The photosensitive member was stopped during formation of the image. Toner on the photosensitive member before the transfer process was peeled off with a transparent adhesive tape, and adhered to a sheet of paper. Further, the transparent adhesive tape was adhered as is to a sheet of paper for use as a reference.

The measurement was performed using the Densitometer TC-6DS manufactured by Tokyo Denshoku Technology Center. The difference with the reference was taken as the fogging value.

(Evaluation Criteria)

A: Reflectance difference on the photosensitive member of 0.5% or less.

B: Reflectance difference on the photosensitive member of 1.0% or less.

C: Reflectance difference on the photosensitive member of more than 1.0%, but fogging does not appear as an image.

D: Reflectance difference on the photosensitive member of more than 1.0%, and fogging can be seen on the image blank portion.

<Transfer Efficiency>

The potential contrast photosensitive member in the above-described evaluation machine was adjusted so that the toner load on the photosensitive member was 0.40 mg/cm$^2$. Then, the image transferred onto a sheet of transfer paper and the transfer residual image density of the photosensitive member were measured using a reflection densitometer manufactured by X-rite (500 Series Spectrodensitometer). Based on the image density, the load was converted to determine the transfer efficiency onto the transfer paper.

(Evaluation Criteria)

A: Toner transfer efficiency of 95% or more.

B: Toner transfer efficiency of 93% or more.

C: Toner transfer efficiency of 90% or more.

D: Toner transfer efficiency of less than 90%.

<Character Reproducibility>

A 30H image was formed using the above-described evaluation machine. This image was visually observed, and the thin line reproducibility of the image was evaluated based on the following criteria. A "30H image" is a halftone image in which 256 gradations are expressed in hexadecimal with 00H as solid white and FFH as solid black.

(Evaluation Criteria)

A: Smooth, with no leathery feel at all.

B: Not much of a leathery feel.

C: Slight leathery feel, but not at a level which would cause problems in practical use.

D: Leathery feel which would be a problem.

<Low-Temperature Fixability>

Using the above-described evaluation machine, in a single-color mode under an ordinary-temperature, ordinary-humidity environment (23° C./60%), the development contrast was adjusted so that the toner load on the sheet of paper was 0.5 mg/cm$^2$, and then a "solid" unfixed image with a leading edge margin of 5 mm, width of 100 mm, and length of 280 mm was produced. As the sheet of paper, thick-sheet A4 paper ("Prover Bond" 105 g/m$^2$, manufactured by Neenah Paper, Inc.) was used.

The fixing unit of the above-described evaluation machine was further modified so that the fixing unit could manually set the fixing temperature. Using this modified fixing unit, a fixing test was performed while increasing the fixing temperature by 10° C. increments in the range of 80° C. to 200° C. under an ordinary-temperature, ordinary-humidity environment (23° C./60%).

Soft, thin paper ("Dasper" (trade name) manufactured by OZU CORPORATION) was rubbed back and forth 5 times over an image region of the obtained fixed image while applying a load of 4.9 KPa. The image densities of the image before and after the rubbing were measured, and the percentage ΔD (%) that the image density decreased was calculated based on the following equation. The temperature at which ΔD (%) was less than 10% was defined as a fixing start temperature, and was used as a criterion for low-temperature fixability.

The image density was measured with an X-Rite color reflection densitometer (Color Reflection Densitometer X-Rite 404A).

$$\Delta D\ (\%) = (\text{Image density before rubbing} - \text{image density after rubbing}) / \text{image density before rubbing} \times 100$$

(Evaluation Criteria)

A: Fixing start temperature is 120° C. or less

B: Fixing start temperature is more than 120° C. and 140° C. or less

C: Fixing start temperature is more than 140° C. and 160° C. or less

D: Fixing start temperature is more than 160° C.

<Charging Performance Evaluation>

The triboelectric charge amount of the toner was measured by the following method.

The above-described two-component was placed in a plastic bottle provided with a cap. The plastic bottle shaken by a shaker (YS-LD, manufactured by YAYOI Co., Ltd.) for 1 minute and 10 minutes at a speed of 4 reciprocations per second, to charge the developer.

Figure 5:
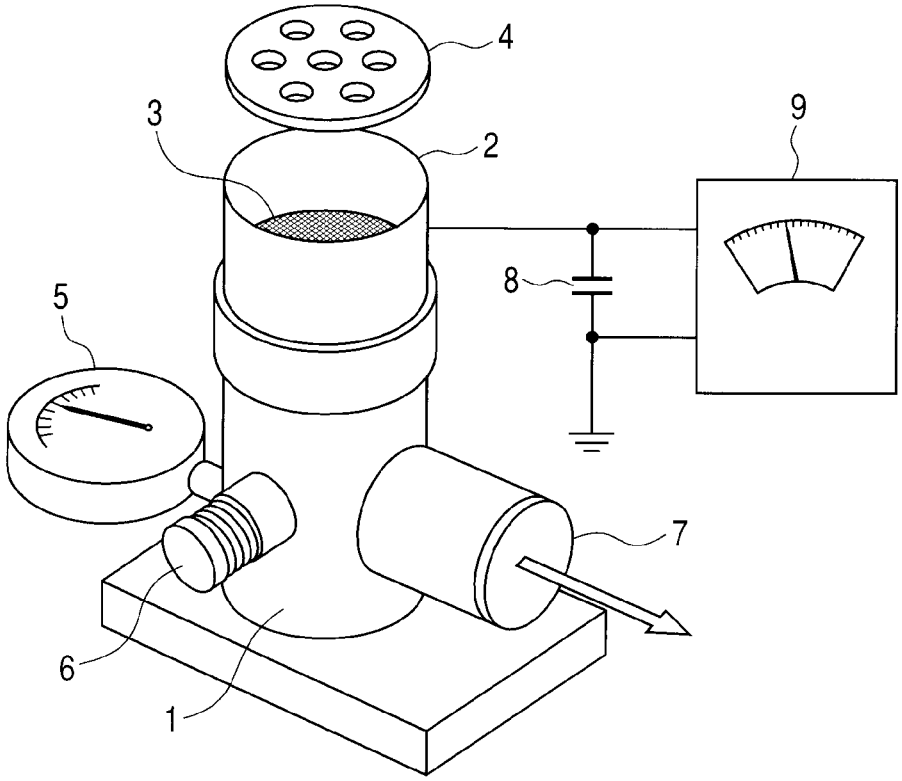
FIG. 5 is a schematic diagram of a charge amount measurement apparatus according to the present invention.

Next, the triboelectric charge amount was measured in the apparatus for measuring triboelectric charge amount illustrated in FIG. 5. In FIG. 5, about 0.5 to 1.5 g of the two-component developer was charged into a metal measurement vessel 2 provided with a 500-mesh (25 μm aperture) screen 3 on the bottom. The measurement vessel 2 is then closed with a metal lid 4. The mass of the whole measurement vessel 2 at this stage was weighed and defined as W1 (g). Next, in an aspirator 1 (at least the portion in contact with the measurement vessel 2 was an insulator), the air in the measurement vessel was sucked from an aspiration port 7 by adjusting an air flow-regulating valve 6 so as to set the pressure of a vacuum gauge 5 to 250 mmAq. In this state, suction was performed for 2 minutes to remove the toner particle by suction. The voltage on an electrometer 9 at this point is defined as V (volt) and a capacity of a condenser 8 is defined as C (mF). In addition, the mass of the whole measurement vessel after suction was weighed, and the result was defined as W2 (g). Then, the triboelectric charge amount (mC/g) of the sample was calculated as follows.

$$\text{Triboelectric charge amount (mC/g) of the sample} = C \times V / (W1 - W2)$$

(Evaluation Criteria)

A: Triboelectric charge amount of the sample of −40.0 or more to less than −20.0.

B: Triboelectric charge amount of the sample of −50.0 or more to less than −40.0, or of −20.0 or more to less than −15.0.

C: Triboelectric charge amount of the sample of less than −50.0 or of −15.0 or more.

<Heat-Resistant Storage Stability>

About 10 g of toner was charged into a 100-ml plastic cup and left to stand at a temperature of 50° C. for 3 days. The toner was then visually evaluated.

(Evaluation Criteria)

A: No aggregations can be seen.

B: Aggregations can be seen, but they easily collapse.

C: Aggregations can be grabbed, but do not easily collapse.

D: Substantial amount of aggregations produced.

<Method for Evaluating Storage Stability Under Harsh Environment>

About 10 g of toner was charged into a 100-ml plastic cup and left to stand at 40° C. under a relative humidity of 95% for 3 days. The toner was then visually evaluated.

(Evaluation Criteria)

A: No aggregations can be seen.

B: Aggregations can be seen, but they easily collapse.

C: Aggregations can be grabbed, but do not easily collapse.

D: Substantial amount of aggregations produced.

Comparative Example 1

Toner 21 was obtained in the same manner as in Example 1, except that the kind of the colorant dispersion used in the oil phase and the kind of the polyester resin solution were changed as illustrated below. The aqueous phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 11 | 40 parts by mass |
| Polyester resin solution 11 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase 1.

Comparative Example 2

Toner 22 was obtained in the same manner as in Example 1, except that the kind of the colorant dispersion used in the oil phase and the kind of the polyester resin solution were changed as illustrated below. The oil phase formulation and the aqueous phase formulation are as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 8 | 40 parts by mass |
| Polyester resin solution 8 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase 1.

Comparative Example 3

Toner 23 was obtained in the same manner as in Example 1, except that the kind of the colorant dispersion used in the oil phase and the kind of the polyester resin solution, and the amount of the resin fine particle dispersion used in the aqueous phase were changed as illustrated below. The aqueous phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 2 | 40 parts by mass |
| Polyester resin solution 2 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 270 parts by mass |
| Resin fine particle dispersion 1 (charged with 2.0 parts by mass of resin fine particles based on 100 parts by mass of toner base particles) | 10 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Comparative Example 4

Toner 24 was obtained in the same manner as in Example 1, except that the amount of the resin fine particle dispersion used in the aqueous phase was changed as illustrated below. The aqueous phase formulation is illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 195 parts by mass |
| Resin fine particle dispersion 1 (charged with 17.0 parts by mass of resin fine particles based on 100 parts by mass of toner base particles) | 85 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Comparative Example 5

Toner 25 was obtained in the same manner as in Example 1, except that the amount of the resin fine particle dispersion used in the aqueous phase was changed as illustrated below. The aqueous phase formulation is illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 272.5 parts by mass |
| Resin fine particle dispersion 1 (charged with 1.5 parts by mass of resin fine particles based on 100 parts by mass of toner base particles) | 7.5 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Comparative Example 6

Toner 26 was obtained in the same manner as in Example 1, except that the process was changed from the aqueous phase until the (Washing and Drying Step), as illustrated below. The aqueous phase formulation, the (Emulsifying and Desolvating Step), and the (Washing and Drying Step) are illustrated below. The toner characteristics are illustrated in Table 4. Further, image evaluation was performed in the same manner as in Example 1. The results are illustrated in Table 5.

(Preparation of Inorganic Aqueous Dispersion Medium)

451 parts by mass of a 0.1 mol/L aqueous solution of $Na_3PO_4$ was charged into 709 parts of ion-exchanged water. The resultant mixture was heated to 60° C., and then the mixture was stirred at 12,000 rpm with a TK-homomixer (manufactured by Primix Corporation). 67.7 parts by mass of a 1.0 mol/L aqueous solution of $CaCl_2$ were gradually added to obtain an inorganic aqueous dispersion medium containing $Ca_3(PO_4)_2$.

(Emulsifying and Desolvating Steps)

| | |
|---|---|
| Above inorganic aqueous dispersion medium | 200 parts by mass |
| 50% aqueous solution of sodium dodecyl diphenyl ether disulfonate (Eleminol MON-7, manufactured by Sanyo Chemical Industries, Ltd.) | 4 parts by mass |
| Ethyl acetate | 16 parts by mass |

The above materials were charged into a beaker, and stirred at 5,000 rpm for 1 minute with a TK-homomixer to prepare an aqueous phase. The speed of the TM homomixer was increased to 8,000 rpm, and the oil phase 1 described in Example 1 (170.5 parts by mass) was charged into the beaker. The resultant mixture was stirred for 3 minutes to suspend the oil phase 1. A stirring blade was set in the beaker, and while stirring at 200 rpm, the temperature in the system was increased to 50° C. to carry out desolvation over 10 hours in a draft chamber, whereby a toner aqueous dispersion was obtained.

(Washing and Drying Step)

The above aqueous toner dispersion was filtered, and the filtrate was charged with 500 parts by mass of ion-exchanged water to form a reslurry. Then, while stirring the system, hydrochloric acid was added to the system until the pH was 1.5 to dissolve the $Ca_3(PO_4)_2$. The resultant mixture was then stirred for 5 minutes.

The above slurry was filtered again, 200 parts by mass of ion-exchanged water was added to the filtrate, and the mixture was stirred for 5 minutes. This series of operations was repeated three times to remove triethylamine remaining in the system, whereby a filtered cake of the toner particles was obtained.

This filtered cake was dried with a warm air dryer at 45° C. for 3 days and sieved with a mesh having an aperture of 75 μm to obtain toner particles.

Comparative Example 7

Toner 27 was obtained in the same manner as in Example 1, except that the kind of the colorant dispersion used in the oil phase was changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 13 | 50 parts by mass |
| Polyester resin solution 1 | 121 parts by mass |
| Polyester resin solution 12 | 9 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

Comparative Example 8

Toner 28 was obtained in the same manner as in Example 1, except that the amount of the colorant dispersion used in the oil phase was changed as illustrated below. The oil phase and the aqueous phase formulation are as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 1 | 16 parts by mass |
| Polyester resin solution 1 | 137.6 parts by mass |
| Polyester resin solution 12 | 26.4 parts by mass |
| Triethylamine | 0.5 parts by mass |
| Ethyl acetate | 19.5 parts by mass |

Comparative Example 9

Toner 29 was obtained in the same manner as in Example 1, except that the added amount of the colorant dispersion used in the oil phase and the kind of the polyester resin solution were changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 1 | 72 parts by mass |
| Polyester resin solution 1 | 102 parts by mass |
| Polyester resin solution 12 | 6 parts by mass |
| Triethylamine | 0.5 parts by mass |
| Ethyl acetate | 19.5 parts by mass |

Example 2

Toner 2 was obtained in the same manner as in Example 1, except that the kind of the colorant dispersion used in the oil phase and the kind of the polyester resin solution were changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 2 | 40 parts by mass |
| Polyester resin solution 2 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

Example 3

Toner 3 was obtained in the same manner as in Example 1, except that the kind of the colorant dispersion used in the oil phase and the kind of the polyester resin solution were changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 3 | 40 parts by mass |
| Polyester resin solution 3 | 140 parts by mass |
| Triethylamine | 0.5 parts by mass |
| Ethyl acetate | 24.5 parts by mass |

The above solutions were charged into a vessel, and stirred and dispersed at 1,500 rpm for 10 minutes with a Homo Disper (manufactured by Primix Corporation) to prepare oil phase.

Example 4

Toner 4 was obtained in the same manner as in Example 1, except that the amount of the resin fine particle dispersion used in the aqueous phase was changed as illustrated below. The aqueous phase formulation is illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 262.5 parts by mass |
| Resin fine particle dispersion 1 (charged with 3.5 parts by mass of resin fine particles based on 100 parts by mass of toner base particles) | 17.5 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 5

Toner 5 was obtained in the same manner as in Example 1, except that the amount of the resin fine particle dispersion used in the aqueous phase was changed as illustrated below. The aqueous phase formulation is illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 230 parts by mass |
| Resin fine particle dispersion 1 (charged with 10.0 parts by mass of resin fine particles based on 100 parts by mass of toner base particles) | 50 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 6

Toner 6 was obtained in the same manner as in Example 1, except that the oil phase formulation was changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 1 | 20 parts by mass |
| Polyester resin solution 1 | 136 parts by mass |
| Polyester resin solution 12 | 24 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

Example 7

Toner 7 was obtained in the same manner as in Example 1, except that the kind of the colorant dispersion used in the oil phase and the kind of the polyester resin solution were changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 4 | 40 parts by mass |
| Polyester resin solution 4 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

Example 8

Toner 8 was obtained in the same manner as in Example 1, except that the kind of the colorant dispersion used in the oil phase and the kind of the polyester resin solution were changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 5 | 40 parts by mass |
| Polyester resin solution 5 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

Example 9

Toner 9 was obtained in the same manner as in Example 1, except that the kind of the colorant dispersion used in the oil phase and the kind of the polyester resin solution were changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 6 | 40 parts by mass |
| Polyester resin solution 6 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

Example 10

Toner 10 was obtained in the same manner as in Example 1, except that the kind of the colorant dispersion used in the oil phase and the kind of the polyester resin solution, and the kind of the resin fine particle dispersion used in the aqueous phase were changed as illustrated below. The oil phase and aqueous phase formulation are as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 7 | 40 parts by mass |
| Polyester resin solution 7 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 2 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 11

Toner 11 was obtained in the same manner as in Example 1, except that the amount of the colorant dispersion used in the oil phase, and the kind of the resin fine particle dispersion used in the aqueous phase were changed as illustrated below. The oil phase and the aqueous phase formulation are as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 12 | 60 parts by mass |
| Polyester resin solution 1 | 115.2 parts by mass |
| Polyester resin solution 12 | 4.8 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 2 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 12

Toner 12 was obtained in the same manner as in Example 1, except that the amount of the colorant dispersion used in the oil phase, and the kind of the resin fine particle dispersion used in the aqueous phase were changed as illustrated below. The oil phase and the aqueous phase formulation are as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 1 | 64 parts by mass |
| Polyester resin solution 1 | 107.6 parts by mass |
| Polyester resin solution 12 | 8.4 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 2 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 13

Toner 13 was obtained in the same manner as in Example 1, except that the kind of the resin fine particle dispersion used in the aqueous phase was changed as illustrated below. The oil phase and the aqueous phase formulation are as illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 3 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 14

Toner 14 was obtained in the same manner as in Example 1, except that the kind of the resin fine particle dispersion used in the aqueous phase was changed as illustrated below. The oil phase and the aqueous phase formulation are as illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 4 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 15

Toner 15 was obtained in the same manner as in Example 1, except that the amount of the colorant dispersion used in the oil phase, and the kind of the resin fine particle dispersion used in the aqueous phase were changed as illustrated below. The oil phase and the aqueous phase formulation are as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 1 | 24 parts by mass |
| Polyester resin solution 1 | 134.4 parts by mass |
| Polyester resin solution 12 | 21.6 parts by mass |

-continued

| | |
|---|---|
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 5 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 16

Toner 16 was obtained in the same manner as in Example 1, except that the kind of the resin fine particle dispersion used in the aqueous phase was changed as illustrated below. The oil phase and the aqueous phase formulation are as illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 6 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 17

Toner 17 was obtained in the same manner as in Example 1, except that the kind of the resin fine particle dispersion used in the aqueous phase was changed as illustrated below. The oil phase and the aqueous phase formulation are as illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 7 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 18

Toner 18 was obtained in the same manner as in Example 1, except that the kind of the resin fine particle dispersion used in the aqueous phase was changed as illustrated below. The aqueous phase formulation is as illustrated below. The toner characteristics are illustrated in Table 4. Further, image evaluation was performed in the same manner as in Example 1. The results are illustrated in Table 5.

(Preparation of Aqueous Phase)

The following materials were charged into a vessel and stirred at 5,000 rpm for 1 minute with a TK-homomixer (manufactured by Primix Corporation) to prepare an aqueous phase.

| | |
|---|---|
| Ion-exchanged water | 240 parts by mass |
| Resin fine particle dispersion 8 (charged with 8.0 parts by mass of resin fine particles based on 100 parts by mass of toner base particles) | 40 parts by mass |
| 50% Aqueous solution of sodium dodecyl diphenyl ether disulfonate (Eleminol MON-7 manufactured by Sanyo Chemical Industries, Ltd.) | 25 parts by mass |
| Ethyl acetate | 30 parts by mass |

Example 19

Toner 19 was obtained in the same manner as in Example 1, except that the kind of the colorant dispersion used in the oil phase and the kind of the polyester resin solution were changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 9 | 40 parts by mass |
| Polyester resin solution 9 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

Example 20

Toner 20 was obtained in the same manner as in Example 1, except that the kind of the colorant dispersion used in the oil phase and the kind of the polyester resin solution were changed as illustrated below. The oil phase formulation is as illustrated below. The toner characteristics are illustrated in Table 4. Further, image evaluation was performed in the same manner as in Example 1. The results are illustrated in Table 5.

(Preparation of Oil Phase)

| | |
|---|---|
| Wax dispersion 1 | 50 parts by mass |
| Colorant dispersion 10 | 40 parts by mass |
| Polyester resin solution 10 | 140 parts by mass |
| Triethylamine | 0.5 parts by mass |
| Ethyl acetate | 19.5 parts by mass |

The above solutions were charged into a vessel, and stirred and dispersed at 1,500 rpm for 10 minutes with a Homo Disper (manufactured by Primix Corporation) to prepare oil phase.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-045639, filed on Feb. 27, 2009, which is hereby incorporated by reference herein in its entirety.

TABLE 3

| | Toner Base Particles (A) | | | | | | | | | |
|---|---|---|---|---|---|---|---|---|---|---|
| | Resin (a) | | WAX | | Colorant | | Resin for Colorant Dispersion | | Surface Layer (B) Resin (b) | |
| | Kind | Added Amount (parts by mass) | Kind | Added Amount (parts by mass) | Kind | Added Amount (parts by mass) | Kind | Added Amount (parts by mass) | Kind | Added Amount (parts by mass) |
| Toner 1 | Polyester-1 | 64.0 | Carnuba 1 | 10.0 | CB | 10.0 | Polyester-12 | 10.0 | Urethane-1 | 8.0 |
| | Polyester-12 | 6.0 | | | | | | | | |
| Toner 2 | Polyester-2 | 70.0 | Carnuba 1 | 10.0 | CB | 10.0 | Polyester-2 | 10.0 | Urethane-1 | 8.0 |
| Toner 3 | Polyester-3 | 70.0 | Carnuba 1 | 10.0 | CB | 10.0 | Polyester-3 | 10.0 | Urethane-1 | 8.0 |
| Toner 4 | Polyester-1 | 64.0 | Carnuba 1 | 10.0 | CB | 10.0 | Polyester-12 | 10.0 | Urethane-1 | 3.5 |
| | Polyester-12 | 6.0 | | | | | | | | |
| Toner 5 | Polyester-1 | 64.0 | Carnuba 1 | 10.0 | CB | 10.0 | Polyester-12 | 10.0 | Urethane-1 | 10.0 |
| | Polyester-12 | 6.0 | | | | | | | | |
| Toner 6 | Polyester-1 | 68.0 | Carnuba 1 | 10.0 | CB | 5.0 | Polyester-12 | 5.0 | Urethane-1 | 8.0 |
| | Polyester-12 | 12.0 | | | | | | | | |
| Toner 7 | Polyester-4 | 70.0 | Carnuba 1 | 10.0 | CB | 10.0 | Polyester-4 | 10.0 | Urethane-1 | 8.0 |
| Toner 8 | Polyester-5 | 70.0 | Carnuba 1 | 10.0 | CB | 10.0 | Polyester-5 | 10.0 | Urethane-1 | 8.0 |

TABLE 3-continued

| | Toner Base Particles (A) | | | | | | | | | |
|---|---|---|---|---|---|---|---|---|---|---|
| | Resin (a) | | WAX | | Colorant | | Resin for Colorant Dispersion | | Surface Layer (B) Resin (b) | |
| | Kind | Added Amount (parts by mass) | Kind | Added Amount (parts by mass) | Kind | Added Amount (parts by mass) | Kind | Added Amount (parts by mass) | Kind | Added Amount (parts by mass) |
| Toner 9 | Polyester-6 | 70.0 | Carnuba 1 | 10.0 | CB | 10.0 | Polyester-6 | 10.0 | Urethane-1 | 8.0 |
| Toner 10 | Polyester-7 | 70.0 | Carnuba 1 | 10.0 | CB | 10.0 | Polyester-7 | 10.0 | Urethane-2 | 8.0 |
| Toner 11 | Polyester-1 | 57.6 | Carnuba 1 | 10.0 | CB | 12.0 | Polyester-12 | 18.0 | Urethane-2 | 8.0 |
| | Polyester-12 | 2.4 | | | | | | | | |
| Toner 12 | Polyester-1 | 53.8 | Carnuba 1 | 10.0 | CB | 16.0 | Polyester-12 | 16.0 | Urethane-2 | 8.0 |
| | Polyester-12 | 4.2 | | | | | | | | |
| Toner 13 | Polyester-1 | 64.0 | Carnuba 1 | 10.0 | CB | 10.0 | Polyester-12 | 10.0 | PES | 8.0 |
| | Polyester-12 | 6.0 | | | | | | | | |
| Toner 14 | Polyester-1 | 64.0 | Carnuba 1 | 10.0 | CB | 10.0 | Polyester-12 | 10.0 | St-Ac | 8.0 |
| | Polyester-12 | 6.0 | | | | | | | | |
| Toner 15 | Polyester-1 | 67.2 | Carnuba 1 | 10.0 | CB | 6.0 | Polyester-12 | 6.0 | Urethane-3 | 8.0 |
| | Polyester-12 | 10.8 | | | | | | | | |
| Toner 16 | Polyester-1 | 64.0 | Carnuba 1 | 10.0 | CB | 10.0 | Polyester-12 | 10.0 | Urethane-4 | 8.0 |
| | Polyester-12 | 6.0 | | | | | | | | |
| Toner 17 | Polyester-1 | 64.0 | Carnuba 1 | 10.0 | CB | 10.0 | Polyester-12 | 10.0 | Urethane-5 | 8.0 |
| | Polyester-12 | 6.0 | | | | | | | | |
| Toner 18 | Polyester-1 | 64.0 | Carnuba 1 | 10.0 | CB | 10.0 | Polyester-12 | 10.0 | Urethane-6 | 8.0 |
| | Polyester-12 | 6.0 | | | | | | | | |
| Toner 19 | Polyester-9 | 70.0 | Carnuba 1 | 10.0 | CB | 10.0 | Polyester-9 | 10.0 | Urethane-1 | 8.0 |
| Toner 20 | Polyester-10 | 70.0 | Carnuba 1 | 10.0 | CB | 10.0 | Polyester-10 | 10.0 | Urethane-1 | 8.0 |
| Toner 21 | Polyester-11 | 70.0 | Carnuba 1 | 10.0 | CB | 10.0 | Polyester-11 | 10.0 | Urethane-1 | 8.0 |
| Toner 22 | Polyester-8 | 70.0 | Carnuba 1 | 10.0 | CB | 10.0 | Polyester-8 | 10.0 | Urethane-1 | 8.0 |
| Toner 23 | Polyester-2 | 70.0 | Carnuba 1 | 10.0 | CB | 10.0 | Polyester-2 | 10.0 | Urethane-1 | 2.0 |
| Toner 24 | Polyester-1 | 64.0 | Carnuba 1 | 10.0 | CB | 10.0 | Polyester-12 | 10.0 | Urethane-1 | 17.0 |
| | Polyester-12 | 6.0 | | | | | | | | |
| Toner 25 | Polyester-1 | 64.0 | Carnuba 1 | 10.0 | CB | 10.0 | Polyester-12 | 10.0 | Urethane-1 | 1.5 |
| | Polyester-12 | 6.0 | | | | | | | | |
| Toner 26 | Polyester-1 | 64.0 | Carnuba 1 | 10.0 | CB | 10.0 | Polyester-12 | 10.0 | — | — |
| | Polyester-12 | 6.0 | | | | | | | | |
| Toner 27 | Polyester-1 | 60.5 | Carnuba 1 | 10.0 | CB | 10.0 | Polyester-1 | 15.0 | Urethane-1 | 8.0 |
| | Polyester-12 | 4.5 | | | | | | | | |
| Toner 28 | Polyester-1 | 68.8 | Carnuba 1 | 10.0 | CB | 4.0 | Polyester-12 | 4.0 | Urethane-1 | 8.0 |
| | Polyester-12 | 13.2 | | | | | | | | |
| Toner 29 | Polyester-1 | 51.0 | Carnuba 1 | 10.0 | CB | 18.0 | Polyester-12 | 18.0 | Urethane-1 | 8.0 |
| | Polyester-12 | 3.0 | | | | | | | | |

* Carbon black is denoted as "CB".

TABLE 4

| | Particle Size (D4) μm | D4/D1 | Tg (° C.) | Tg(4.0) − Tg(0.5) (° C.) | A600/Cb1 | A600/Cb2 | tanδ | Volume Resistivity (Ω · cm) | Carbon Black Dispersion Diameter (nm) | Toner Amount of Water Absorption (mass %) |
|---|---|---|---|---|---|---|---|---|---|---|
| Toner 1 | 5.5 | 1.15 | 45 | 5.2 | 0.02 | 4.61 | 0.008 | $6 \times 10^{14}$ | 150 | 1.1 |
| Toner 2 | 5.5 | 1.15 | 37 | 5.1 | 0.02 | 4.72 | 0.011 | $6 \times 10^{14}$ | 142 | 1.2 |
| Toner 3 | 5.5 | 1.15 | 58 | 5.3 | 0.01 | 4.62 | 0.014 | $5 \times 10^{14}$ | 146 | 0.9 |
| Toner 4 | 5.7 | 1.17 | 45 | 2.1 | 0.12 | 4.62 | 0.008 | $6 \times 10^{14}$ | 152 | 1.1 |
| Toner 5 | 5.0 | 1.14 | 45 | 9.8 | 0.01 | 4.62 | 0.008 | $7 \times 10^{14}$ | 150 | 1.1 |
| Toner 6 | 5.5 | 1.15 | 45 | 5.1 | 0.02 | 2.21 | 0.008 | $6 \times 10^{14}$ | 130 | 1.2 |
| Toner 7 | 5.6 | 1.18 | 44 | 5.1 | 0.02 | 3.53 | 0.013 | $5 \times 10^{14}$ | 159 | 1.3 |
| Toner 8 | 5.5 | 1.15 | 43 | 5.3 | 0.02 | 4.77 | 0.011 | $6 \times 10^{14}$ | 157 | 1.4 |
| Toner 9 | 5.5 | 1.15 | 47 | 5.1 | 0.02 | 4.41 | 0.012 | $6 \times 10^{14}$ | 148 | 0.6 |
| Toner 10 | 5.5 | 1.15 | 42 | 5.1 | 0.02 | 4.61 | 0.011 | $6 \times 10^{14}$ | 150 | 1.1 |
| Toner 11 | 5.5 | 1.15 | 45 | 5.1 | 0.02 | 6.44 | 0.016 | $4 \times 10^{14}$ | 600 | 1.2 |
| Toner 12 | 5.5 | 1.15 | 45 | 5.2 | 0.02 | 6.23 | 0.022 | $3 \times 10^{14}$ | 470 | 1.1 |
| Toner 13 | 5.8 | 1.17 | 44 | 5.0 | 0.02 | 3.54 | 0.008 | $1 \times 10^{13}$ | 150 | 1.1 |
| Toner 14 | 5.9 | 1.21 | 46 | 5.3 | 0.02 | 3.41 | 0.008 | $5 \times 10^{14}$ | 146 | 1.3 |
| Toner 15 | 5.5 | 1.15 | 45 | 6.2 | 0.02 | 4.61 | 0.008 | $6 \times 10^{14}$ | 150 | 1.2 |
| Toner 16 | 5.6 | 1.16 | 45 | 7.5 | 0.01 | 4.63 | 0.008 | $6 \times 10^{14}$ | 150 | 1.2 |
| Toner 17 | 5.5 | 1.15 | 46 | 5.1 | 0.02 | 4.46 | 0.008 | $6 \times 10^{14}$ | 144 | 1.1 |
| Toner 18 | 5.7 | 1.17 | 45 | 5.2 | 0.02 | 4.68 | 0.008 | $6 \times 10^{14}$ | 320 | 1.1 |
| Toner 19 | 5.5 | 1.15 | 57 | 5.2 | 0.01 | 4.51 | 0.012 | $5 \times 10^{14}$ | 210 | 1.7 |
| Toner 20 | 5.5 | 1.15 | 49 | 5.3 | 0.01 | 4.62 | 0.014 | $4 \times 10^{14}$ | 230 | 0.4 |
| Toner 21 | 5.6 | 1.16 | 33 | 5.1 | 0.02 | 4.53 | 0.013 | $6 \times 10^{14}$ | 150 | 1.6 |
| Toner 22 | 5.4 | 1.13 | 62 | 5.1 | 0.02 | 4.55 | 0.011 | $6 \times 10^{14}$ | 152 | 0.8 |
| Toner 23 | 5.8 | 1.18 | 37 | 1.6 | 0.20 | 4.42 | 0.008 | $6 \times 10^{14}$ | 150 | 1.1 |

TABLE 4-continued

| | Particle Size (D4) μm | D4/D1 | Tg (° C.) | Tg(4.0) − Tg(0.5) (° C.) | A600/ Cb1 | A600/ Cb2 | tanδ | Volume Resistivity (Ω · cm) | Carbon Black Dispersion Diameter (nm) | Toner Amount of Water Absorption (mass %) |
|---|---|---|---|---|---|---|---|---|---|---|
| Toner 24 | 5.0 | 1.14 | 45 | 11.5 | 0.01 | 4.47 | 0.008 | $6 \times 10^{14}$ | 150 | 1.1 |
| Toner 25 | 6.0 | 1.19 | 45 | 0.3 | 1.50 | 4.51 | 0.042 | $6 \times 10^{14}$ | 153 | 1.1 |
| Toner 26 | 5.8 | 1.15 | 45 | 0.1 | 10.02 | 4.54 | 0.051 | $4 \times 10^{10}$ | 140 | 1.2 |
| Toner 27 | 5.7 | 1.16 | 44 | 1.3 | 0.40 | 4.56 | 0.040 | $4 \times 10^{13}$ | 380 | 1.1 |
| Toner 28 | 5.5 | 1.14 | 45 | 5.1 | 0.01 | 1.70 | 0.013 | $4 \times 10^{14}$ | 152 | 1.1 |
| Toner 29 | 5.5 | 1.14 | 45 | 5.1 | 0.02 | 7.13 | 0.025 | $4 \times 10^{14}$ | 520 | 1.1 |

TABLE 5

| | | Heat-Resistance Storage Stability | Storage Stability Under Harsh Environment | Low-Temperature Fixability | Charging Performance | Reflection Density | Blank Fogging | Transfer Efficiency | Character Reproduc-ibility |
|---|---|---|---|---|---|---|---|---|---|
| Example 1 | Toner 1 | A | A | A | A | A | A | A | A |
| Example 2 | Toner 2 | B | A | A | A | A | A | A | B |
| Example 3 | Toner 3 | A | A | B | A | A | A | A | A |
| Example 4 | Toner 4 | B | B | A | A | A | A | A | B |
| Example 5 | Toner 5 | A | A | B | A | A | A | A | A |
| Example 6 | Toner 6 | A | A | A | A | B | A | A | A |
| Example 7 | Toner 7 | A | B | A | A | A | A | A | A |
| Example 8 | Toner 8 | A | B | A | B | A | A | A | A |
| Example 9 | Toner 9 | A | A | A | B | A | A | A | A |
| Example 10 | Toner 10 | A | A | A | B | A | A | A | A |
| Example 11 | Toner 11 | A | A | A | B | A | A | B | B |
| Example 12 | Toner 12 | A | A | A | A | A | B | B | B |
| Example 13 | Toner 13 | B | B | A | A | A | A | A | B |
| Example 14 | Toner 14 | A | A | B | A | A | A | A | A |
| Example 15 | Toner 15 | A | A | B | A | A | A | A | A |
| Example 16 | Toner 16 | B | A | B | A | A | A | A | A |
| Example 17 | Toner 17 | A | B | A | A | A | A | A | A |
| Example 18 | Toner 18 | A | A | A | B | A | A | A | A |
| Example 19 | Toner 19 | A | C | A | B | A | A | C | A |
| Example 20 | Toner 20 | A | A | A | B | A | A | B | A |
| Comparative Example 1 | Toner 21 | C | D | B | C | B | C | C | B |
| Comparative Example 2 | Toner 22 | A | A | D | A | A | A | A | A |
| Comparative Example 3 | Toner 23 | C | B | A | A | A | A | B | B |
| Comparative Example 4 | Toner 24 | A | A | D | A | A | A | A | A |
| Comparative Example 5 | Toner 25 | D | D | A | A | A | A | B | B |
| Comparative Example 6 | Toner 26 | D | D | A | C | A | C | B | A |
| Comparative Example 7 | Toner 27 | C | C | B | C | B | C | D | D |
| Comparative Example 8 | Toner 28 | A | A | A | A | C | A | A | A |
| Comparative Example 9 | Toner 29 | A | C | A | C | A | B | A | C |

The invention claimed is:

1. A black toner comprising a toner particle, which comprises at least a resin (a) having a polyester as a main component, carbon black, and a wax, and a fine inorganic particle, wherein when the glass transition temperatures of the black toner measured by DSC at a rate of temperature rise of 0.5° C./min and 4.0° C./min are defined as Tg(0.5) (° C.) and Tg(4.0) (° C.) respectively, the Tg(0.5) is 35.0° C. or more to 60.0° C. or less, and the difference between the Tg(4.0) and the Tg(0.5) [Tg(4.0)−Tg(0.5)] is 2.0° C. or more to 10.0° C. or less, wherein, when preparing a solution of which the black toner is dissolved in ethyl acetate, and defined the concentration thereof as Cb1 (mg/mL), and the light absorbance thereof at a wavelength of 600 nm as A600, the ratio of A600 to Cb1 (A600/Cb1) is less than 0.15, and wherein, when preparing a solution of which the black toner is dissolved in chloroform, and defined the concentration thereof as Cb2 (mg/mL), and the light absorbance thereof at a wavelength of 600 nm as A600, the ratio of A600 to Cb2 (A600/Cb2) is 2.00 or more to 6.55 or less.

2. The black toner according to claim 1, wherein the polyester included in the resin (a) having a polyester as a main component contains a diol unit as a constituent component, wherein the diol unit contains 50.0 mass % or more of an aliphatic diol unit having 4 to 12 (inclusive thereof) carbon atoms, and the amount of water absorption of the black toner under an environment having a temperature of 40° C. and a humidity of 95% RH is 0.5 mass % or more to 1.5 mass % or less.

3. The black toner according to claim 1, wherein that the amount of water absorption of the resin (a) under an environment having a temperature of 40° C. and a humidity of 95% RH is 0.5 mass % or more to 1.5 mass % or less.

4. The black toner according to claim 1, wherein the acid value of the resin (a) is 20.0 mg KOH/g or less.

5. The black toner according to claim 1, wherein the hydroxyl group value of the resin (a) is 20.0 mg KOH/g or more to 80.0 mg KOH/g or less.

6. The black toner according to claim 1, wherein the carbon black has a content of 5.0 mass % or more to 15.0 mass % or less based on the toner particle.

7. The black toner according to claim 1, wherein the black toner has a dielectric loss tangent (tan δ), represented by dielectric loss ε"/dielectric loss ε', at a frequency of 100,000 Hz of 0.020 or less, and a volume resistivity of $1\times10^{12}$ Ω·cm or more.

8. The black toner according to claim 1, wherein a number average dispersion diameter of the carbon black in a cross-sectional photograph of the toner particle taken by a transmission electron microscope (TEM) is 100 nm or less to 500 nm or more.

9. The black toner according to claim 1, wherein the toner particle is a capsule-type toner particle having a surface layer (B) having a urethane resin (b) as a main component on a surface of a toner base particle (A) having at least the resin (a) having a polyester as a main component, carbon black, and a wax.

10. The black toner according to claim 9, wherein the urethane resin (b) is a resin comprising a reaction product of a prepolymer diol component and a diisocyanate component, wherein when the total number of moles of the diol component is [OH] (mol), and the total number of moles of the isocyanate component is [NCO] (mol), the ratio of the [NCO] to the [OH] ([NCO]/[OH]) is 0.50 or more to 1.00 or less, and the urethane resin (b) is a resin polymerized using at least 1.0 mass % or more to 30.0 mass % or less of a diol containing a carboxyl group and 10.0 mass % or more to 30.0 mass % or less of a diisocyanate.

11. The black toner according to claim 9, wherein the amount of water absorption of the urethane resin (b) under an environment having a temperature of 40° C. and a humidity of 95% RH is 3.5 mass % or less.

12. The black toner according to claim 9, wherein when an acid value Vb obtained by measuring a dissolved product of the urethane resin (b) dissolved in tetrahydrofuran by a titration method is Vb (mg KOH/g), the Vb is 10.0 mg KOH/g or more to 50.0 mg KOH/g or less.

13. The black toner according to claim 1, wherein the toner particle is obtained by dissolving a dissolved product or a dispersion product obtained by dissolving or dispersing at least the resin (a) having a polyester as a main component, carbon black, and a wax in an organic medium in an aqueous medium in which resin fine particles having the urethane resin (b) as a main component are dispersed, removing the solvent from an obtained dispersion, and drying a resultant product.

* * * * *